US007240982B2

(12) United States Patent
Sanpei et al.

(10) Patent No.: US 7,240,982 B2
(45) Date of Patent: Jul. 10, 2007

(54) INK-JET LINE PRINTER AND IMAGE FORMING APPARATUS USING THE SAME

(75) Inventors: Koichi Sanpei, Kawasaki (JP); Mitsuhiro Mori, Kawasaki (JP); Akira Iwaishi, Kawasaki (JP); Shigeyoshi Nakamura, Kawasaki (JP); Katsumi Tateno, Kawasaki (JP)

(73) Assignee: Fuji Xerox Co., Ltd., Tokyo (JP)

( * ) Notice: Subject to any disclaimer, the term of this patent is extended or adjusted under 35 U.S.C. 154(b) by 296 days.

(21) Appl. No.: 10/493,852

(22) PCT Filed: Mar. 7, 2002

(86) PCT No.: PCT/JP02/02098

§ 371 (c)(1),
(2), (4) Date: Apr. 28, 2004

(87) PCT Pub. No.: WO03/074277

PCT Pub. Date: Sep. 12, 2003

(65) Prior Publication Data

US 2004/0246293 A1 Dec. 9, 2004

(51) Int. Cl.
*B41J 2/165* (2006.01)

(52) U.S. Cl. ..... 347/23; 347/29; 347/30

(58) Field of Classification Search ..... 347/22–36
See application file for complete search history.

(56) References Cited

U.S. PATENT DOCUMENTS 5,428,375 A 6/1995 Simon et al.
2001/0026299 A1* 10/2001 Tsujimoto et al. ..... 347/30

FOREIGN PATENT DOCUMENTS

| | | |
|---|---|---|
| JP | A 6-219009 | 8/1994 |
| JP | A-06-219009 | 8/1994 |
| JP | A 7-81049 | 3/1995 |
| JP | A-08-267773 | 10/1996 |
| JP | A 11-20175 | 1/1999 |
| JP | A-11-058877 | 3/1999 |
| JP | A-2000-006385 | 1/2000 |
| JP | A 2000-218884 | 8/2000 |
| JP | A-2000-275920 | 10/2000 |
| JP | A 2001-105635 | 4/2001 |
| JP | A-2001-129983 | 5/2001 |
| JP | A-2002-067279 | 3/2002 |

* cited by examiner

*Primary Examiner*—Stephen Meier
*Assistant Examiner*—Ly T. Tran
(74) *Attorney, Agent, or Firm*—Oliff & Berridge, PLC

(57) ABSTRACT

An ink-jet line printer (30) is constituted by multiple ink-jet heads (1-1 to 1-3). Actuators (3-1 to 3-3) are arranged so as to be moved between a home position and a print position, and backup mechanisms (2-1 to 2-3) are arranged at home positions. In this ink-jet line printer, the ink-jet heads can be protected and recovered by backup mechanisms, thus making high-speed continuous printing possible. Even though the backup mechanisms are incorporated, a compact apparatus can still be achieved.

4 Claims, 22 Drawing Sheets

INK-JET LINE PRINTER AND IMAGE FORMING APPARATUS USING THE SAME

TECHNICAL FIELD

The present invention relates to an ink-jet line printer which sprays out ink to perform printing and an image forming apparatus using the ink-jet line printer and, more particularly, to an ink-jet line printer which uses an ink-jet head which performs printing over one line at the same time, and an image forming apparatus using the ink-jet line printer.

PRIOR ART

Since an ink-jet printer sprays out, from a nozzle, ink contained in an ink chamber to perform printing, a simple structure can be achieved, and color printing can be easily performed by changing the colors of inks in the ink chamber.

A serial type printer is commonly used as such an ink-jet printer. In a serial type ink-jet printer, an ink-jet head moves along a stay shaft extending from a home position (a standby position or a capping position). The stay shaft sets a main scanning direction such that the surface of a nozzle of an ink-jet head and the printing paper are horizontal. While moving along the stay shaft, the ink-jet head sprays ink particles from the surfaces of the nozzles and performs printing.

Since this serial type ink-jet printer performs printing on one line while moving the head in the main scanning direction, the printing time becomes long, and in a field in which high-speed printing is demanded, a line ink-jet printer is demanded which performs printing over one line at the same time. A conventional line ink-jet printer will be described by means of FIGS. 33 and 34.

As shown in FIG. 34, a full-line type ink-jet head 128 is arranged such that printing of an entire printing width of a sheet of paper 100 is performed at the same time, and the full-line type ink-jet head 128 performs printing 110 without moving in the main scanning direction. The fact that the full-line type ink-jet head 128 is constituted as one unit is a factor contributing to an increase in costs. For example, a single head having 6480 nozzles needs to be used to perform printing over an 18-inch width at a printing density of 360 dpi.

For this reason, a method has been proposed which aligns multiple unit heads to achieve a full-line head. For example, a method has been proposed which arranges multiple unit heads in a zigzag pattern to connect the unit heads (for example, Japanese Patent Application Laid-Open (JP-A) No. 11-20175), as well as a method which arranges multiple unit heads in a zigzag pattern and isolates the unit heads such that the positions of the unit heads can be finely adjusted (JP-A No. 6-219009).

As shown in FIG. 35, a shuttle-type printer has also been proposed in which several to over ten heads 129*a* to 129*d* are arranged to cover a printing width of a sheet of paper 100 and to perform printing in a short scanning width (for example, JP-A No. 7-81049). According to this shuttle method, a printing width covered by each individual head diminishes, depending on the number of printing heads used, and a printing speed can thus be improved.

However, in the method in which unit heads are connected as in FIG. 34, or in the shuttle head shown in FIG. 35, if the fixing accuracy of the unit heads is not set at a high level, defects in printing such as missing dots and slanting of lines tend to occur. For example, at 360 dpi, a dot diameter is 70 μm, and a pitch of dots connected by an oblique line is accordingly $70/\sqrt{2}=49.5$ μm. In this case, a dot radius is 35 μm when a half of the dot pitch is 24.8 μm, whereby a displacement tolerance is no more than about 10 μm. In general, it is extremely difficult to manufacture a printer with a machine fixing accuracy of this order.

Furthermore, in an ink-jet head, defects easily occur in the spraying of ink particles, as a result of the clogging up of nozzles and the mixing of ink and air bubbles. A backup thus becomes necessary to remedy such defects. However, installation of a backup mechanism for recovering a line head or a shuttle head, of defects in the spraying of ink particles caused by the clogging up of nozzles or by the mixing of ink and air bubbles, itself requires a home position for the entire head. There is accordingly a risk that the apparatus may need to be increased in size, or may become unnecessarily complicated.

SUMMARY OF THE INVENTION

The present invention accordingly provides an ink-jet line printer and an image forming apparatus which protect and recover the surfaces of nozzles of ink-jet heads, even when the ink-jet line printer is of a full-line type.

The invention has as another object to provide an ink-jet line printer and an image forming apparatus which can easily arrange backup mechanisms for ink-jet heads, even when the ink-jet line printer is of a full-line type.

The invention has as still another object to provide an ink-jet line printer and an image forming apparatus which can easily and compactly achieve a backup of ink-jet heads, even when the ink-jet line printer is of a full-line type.

The invention has as still another object to provide an image forming apparatus which can easily impart a color printing function to a high-speed electrophotographic printer.

The invention has as still another object to provide an ink-jet line printer and an image forming apparatus which can elongate the life span of ink-jet heads, even when the ink-jet line printer is of a full-line type.

The invention has as still another object to provide an ink-jet line printer and an image forming apparatus which make it easy to arrange the positioning of ink-jet heads, even when the ink-jet line printer is a full-line type ink-jet printer constituted by multiple ink-jet heads.

The ink-jet line printer according to the invention accordingly includes: multiple ink-jet heads arranged to cover multiple printing regions divided in a line direction of a printing medium and having multiple nozzles for spraying ink in the line direction; a backup mechanism, arranged at a home position on a side of the printing medium, for protecting and recovering the nozzles of the multiple ink-jet heads; an actuator which moves the ink-jet heads in the line direction between the home position and predetermined print positions in the line direction; and a controller which, when a printing operation is to be performed in the line direction, positions the ink-jet heads at predetermined print positions in the line direction and performs printing by spraying ink while remaining in a stationary state, and which moves the ink-jet heads to the home position to enable the backup mechanism to protect and recover the nozzles.

In the invention, in an ink-jet line printer having multiple ink-jet heads which divide the printing medium region into multiple regions in a width direction and perform printing in these regions while remaining stationary, the ink-jet heads are designed to move between the home position set on a side of the printing medium and printing positions. For this reason, even when the ink-jet line printer is a full-line ink-jet printer, the backup mechanism arranged at the home position can prevent the surfaces of nozzles of the ink-jet heads from becoming dry and from being affected by dust and can eliminate air bubbles in the nozzles, whereby a small-size and high-speed line type ink jet printer can be provided.

The nozzles of the heads can be recovered in the event of defects in spraying and thus a highly reliable line type ink-jet printer can be provided. Due to provision for a backup mechanism for the ink nozzles, a line type ink-jet printer can be provided which can be easily maintained.

In the invention, preferably, the backup mechanism has caps covering the surfaces of the nozzles of the ink-jet heads and a purging mechanism which purges the insides of caps. In this manner, with a single mechanism, the drying of the nozzles of the ink-jet heads can be prevented and the elimination of air bubbles and the like can be achieved.

In the invention, preferably, the actuator is constituted by multiple guide rails for guiding the ink-jet heads in the line direction, and multiple stages for moving the ink-jet heads along the guide rails of the ink-jet heads. In this manner, individual ink-jet heads can be isolated and moved between the home position and printing positions.

In the invention, preferably, the stages have a first actuator for moving the ink-jet heads in the line direction, and a second actuator for moving the ink-jet heads in a direction perpendicular to the line direction. In this manner, displacements between the ink-jet heads can also be corrected.

In the invention, preferably, on a conveyance path positioned opposite to the surfaces of the nozzles of the ink-jet heads, a tension imparting unit is provided that imparts tension to the printing medium. Accordingly, clearance between the surfaces of the nozzles of the ink-jet heads and the printing medium can be assured at a fixed level, and high printing quality can be maintained even in the case of high-speed printing.

In the invention, preferably, the controller measures continuous printing times of the ink-jet heads at a printing position. When a continuous printing time is longer than a predetermined set time, the controller moves the ink-jet heads from the printing position to the home position, recovers the nozzles by means of the backup mechanism, and moves the ink-jet heads back to the printing position.

In this manner, even in the case of continuous printing, defects in printing can be anticipated and prevented, and reliability of continuous printing can be enhanced.

In the invention, preferably, the ink-jet line printer further includes covers covering the caps, and a drive mechanism for opening the covers when the ink-jet heads are located at the position of a cap. In this way, the cap can also be protected from paper powder or dust, and a function of protecting the surfaces of the nozzles of the ink-jet heads can be further enhanced.

In the invention, preferably, an image pickup mechanism is arranged on the downstream side of the ink-jet heads for reading results of printing by the printing medium, and the controller analyzes the results read by the image pickup mechanism. By detecting faults in the nozzles of the ink-jet heads, it becomes possible to detect defects in the nozzles at an early stage.

In the invention, preferably, when a defect in the nozzles is detected, the controller moves the ink-jet heads from a printing position to the home position, performs a recovery operation on the nozzles by means of the backup mechanism, and moves the ink-jet heads back to a printing position. In this manner, defects in nozzles are detected, recovery operations are automatically performed, and a printing operation can be restarted.

In the invention, preferably, home positions for the backup mechanism are set on both sides of the printing medium, and the ink-jet line printer can accordingly be reduced in size.

Further, in the invention, the home positions set on both sides of the printing medium can be opposed to each other on opposite sides of the printing medium, and the ink-jet line printer can accordingly be further reduced in size.

In the invention, preferably, the controller measures frequencies of ink spraying of the ink-jet heads and on the basis of the results alternates the printing positions of the ink-jet heads in relation to each other. Loads on the ink-jet heads are accordingly spread out and the life spans of the ink-jet heads can accordingly be extended.

In the invention, preferably, the controller measures frequencies of ink spraying by the nozzles of the ink-jet heads and on the basis of differences between frequencies of ink spraying by nozzles of ink-jet heads at the same position alternates printing positions of the ink-jet heads. Accurate spreading out of loads of ink-jet heads accordingly becomes possible.

In the invention, preferably, an image pickup mechanism is arranged on the downstream side of the ink-jet heads for reading results of printing by the printing medium. The controller analyzes the results read by the image pickup mechanism, measures displacements of the multiple ink-jet heads, and controls the stages to correct displacements of the ink-jet heads. Accordingly, even in the case of a line printer in which ink-jet heads are movable, displacements of ink-jet heads can be reduced and print quality can be improved.

In the invention, preferably, on the basis of the results read by the image pickup mechanism, the controller measures inclinations of ink-jet heads in rotating directions and controls the stages to correct inclinations of the ink-jet heads. Fixing accuracies of the multiple ink-jet heads can accordingly be automatically corrected and a fixing operation becomes a simple matter.

In the invention, preferably, on the basis of the results read by the image pickup mechanism, the controller measures displacements of the ink-jet heads in both line and conveyance directions, and controls the stages to correct displacements of the ink-jet heads. Mechanical errors in the multiple ink-jet heads can thus automatically be corrected, and fixing accuracies adjusted, and it becomes easy both to manufacture and to fix the heads.

In addition, a color image forming apparatus according to the invention includes: an image forming mechanism which forms on a printing medium a toner image of a first color; and an ink-jet line printer which by spraying ink of a second color performs printing at the same time over a line of the printing medium crossing a convey direction of the printing medium. The ink-jet line printer includes: multiple ink-jet heads arranged to cover multiple printing regions divided in a line direction of the printing medium and having multiple ink spraying nozzles in the line direction; a backup mechanism, arranged at a home position on a side of the printing medium, for protecting and recovering the nozzles of the multiple ink-jet heads; an actuator which moves the ink-jet heads in the line direction between the home position and predetermined printing positions in the line direction; and a controller which for a printing operation in the line direction positions the ink-jet heads the predetermined printing positions in the line direction, performs printing by spraying ink while remaining in a stationary state, and when a printing operation is not about to be performed moves the ink-jet heads to the home position, thus enabling the backup mechanism to protect and recover the nozzles.

In this manner, the ink-jet line printer is added to an image forming mechanism which performs high-speed printing, and color printing can easily be performed while high-speed printing is maintained by the image forming mechanism. The printing medium is divided into multiple regions in a width direction, and the ink-jet line printer is constituted by multiple ink-jet heads which perform printing for regions while remaining in a stationary condition. The ink-jet heads are moved between the home position set on a side of the printing medium and the printing positions. For this reason, even when the ink-jet line printer is a full-line ink-jet printer, the backup mechanism arranged at the home position can prevent the surfaces of the nozzles of the ink-jet heads from becoming dry or being affected by dust, can also eliminate air bubbles in the nozzles, and can recover the nozzles of the heads in the event of defects in spraying occurring. Due to this, a color image forming apparatus can be provided which has high reliability and is capable of performing continuous printing.

In the invention, preferably, a control mechanism is provided which controls the image forming mechanism according to one printing instruction from a host computer and transmits to the controller another instruction to make the ink-jet line printer start printing, which another instruction being included in the one printing instruction. In this manner, the ink-jet line printer can easily be incorporated into the image forming mechanism.

In the invention, preferably, the image forming mechanism is an electrophotographic mechanism, so that a color printing function can easily be imparted while high-speed printing is performed. In the invention, preferably, the printing medium is a continuous form, so that continuous printing can be easily achieved.

DETAILED DESCRIPTION OF THE INVENTION

Embodiments of the present invention will be described in the order named: an ink-jet line printer, an image forming apparatus, control of the ink-jet line printer, another ink-jet line printer, alternating control of arrangement of ink-jet heads, positional adjustment of ink-jet heads, and other embodiments.

[Ink-Jet Line Printer]

Figure 1:
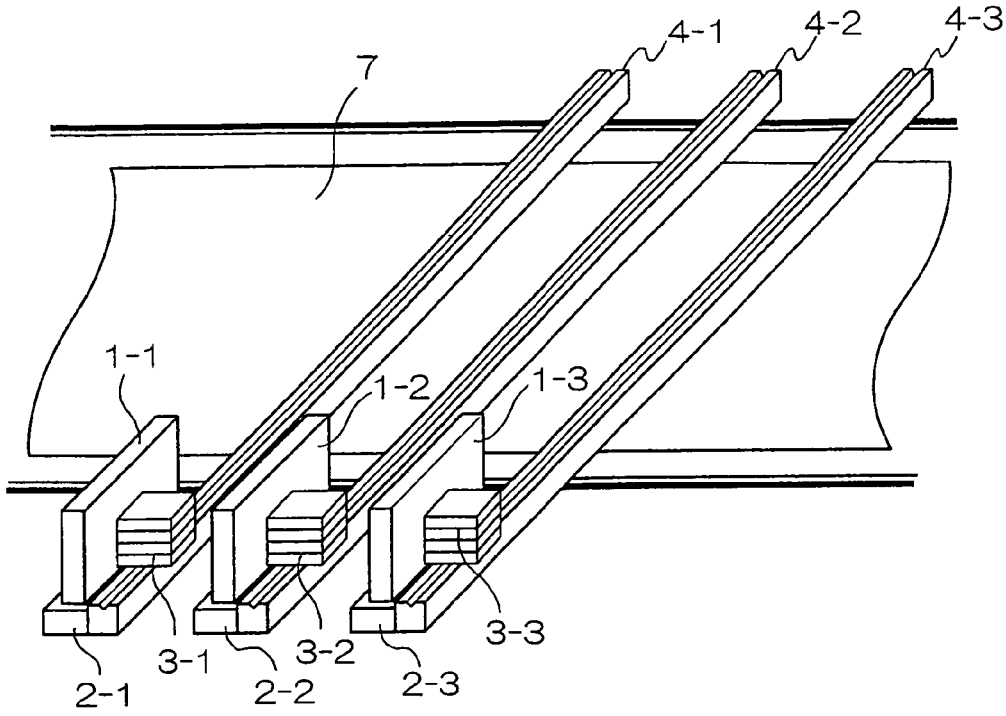
FIG. 1 is a diagram showing the configuration of an ink-jet line printer according to an embodiment of the present invention.
Figure 2:
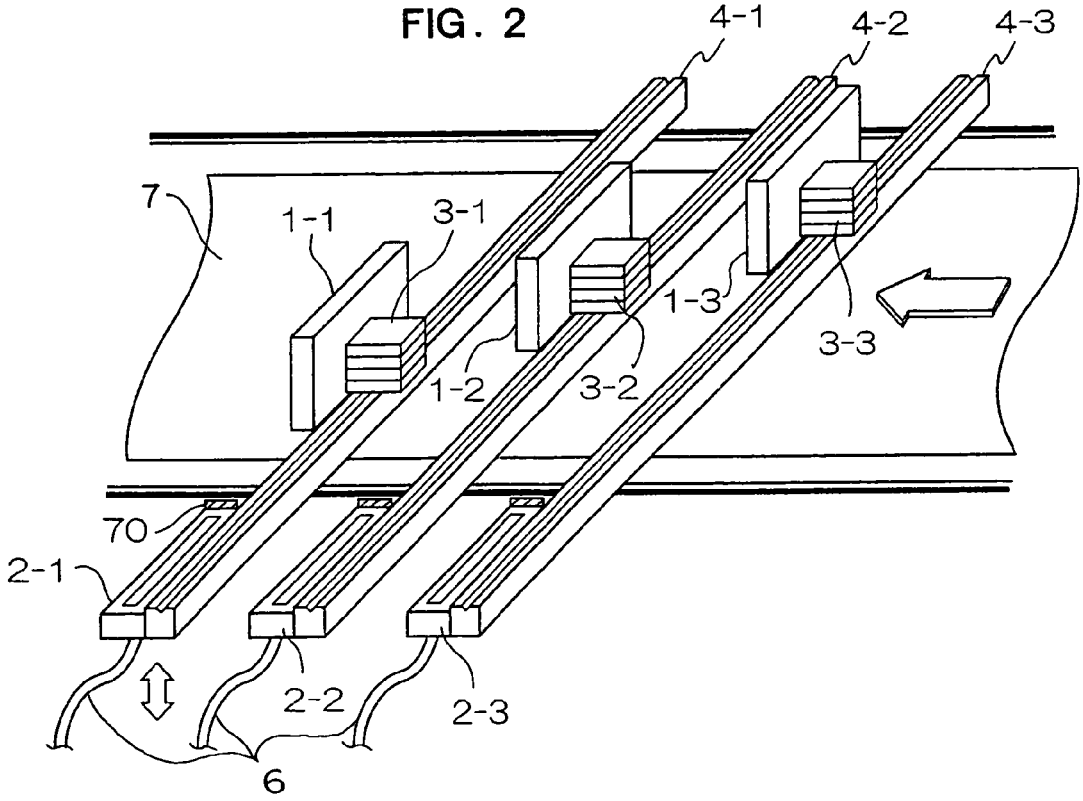
FIG. 2 is a diagram for explaining a printing operation of the ink-jet line printer in FIG. 1.

FIGS. 1 and 2 are diagrams showing configurations of an ink-jet line printer. FIG. 1 shows a state in which ink-jet heads are located at a home position, and FIG. 2 shows a state in which the ink-jet heads are located at a printing position.

As shown in FIG. 1, three guide rails 4-1 to 4-3 are arranged in the width direction of a printing medium 7 such as a sheet of paper. Stages 3-1 to 3-3 to which ink-jet heads 1-1 to 1-3 are fixed are arranged on the guide rails 4-1 to 4-3, respectively. The ink-jet heads 1-1 to 1-3 are arranged on the stages 3-1 to 3-3, respectively, such that the surfaces of the nozzles face downward. The stages 3-1 to 3-3 move along the guide rails 4-1 to 4-3, respectively.

At home positions shown in FIG. 1, head caps 2-1 to 2-3 are arranged. At the home positions, the head caps 2-1 to 2-3 cover the surfaces of the nozzles of the head caps 2-1 to 2-3 to protect the nozzles or to perform cleaning of the nozzles.

Figure 3:
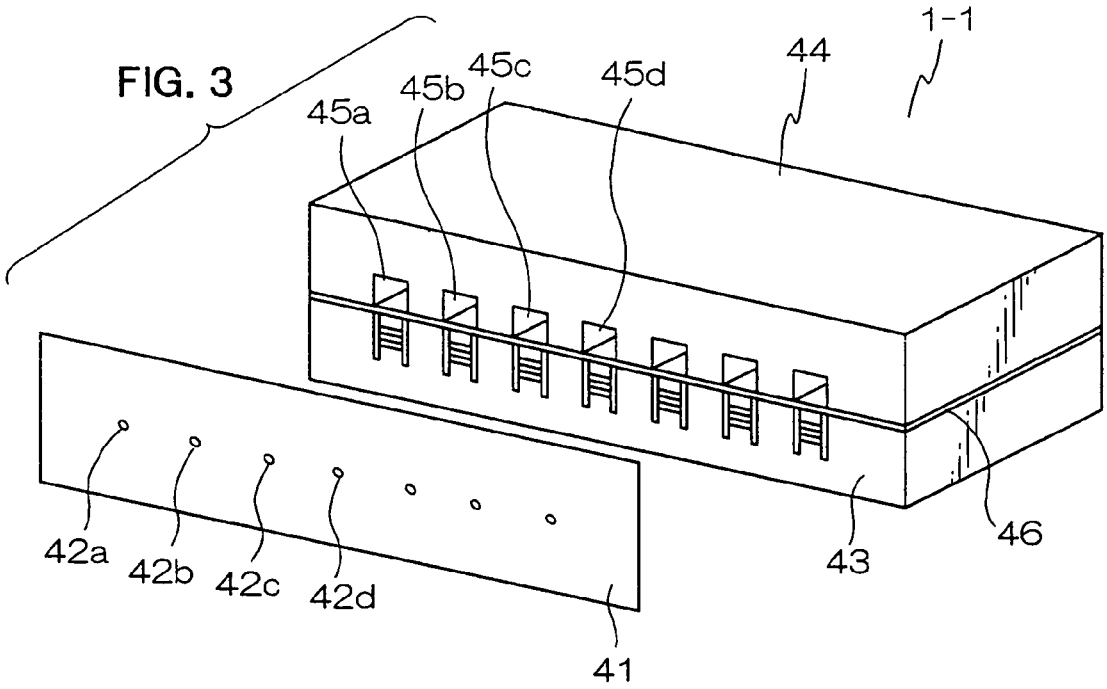
FIG. 3 is a perspective view of the ink-jet head in FIG. 1.

Before a detailed explanation of FIGS. 1 and 2 is given, the constituent elements of a line type ink-jet printer will be described below. FIG. 3 is a perspective view of the ink-jet head 1-1, and FIG. 4 is a sectional view of the ink-jet head.

As shown in FIG. 3, on a nozzle plate 41, a large number of nozzle holes 42*a* to 42*d* are formed. A pressure chamber plate 44 forms a large number of ink chambers 45*a* to 45*d*. A piezoelectric element 43 is joined to the pressure chamber plate 44 by a joint member 46, and deformed by application of voltage, thereby exerting pressure on the ink chambers 45*a* to 45*d* of the pressure chamber plate 44 by way of the joint member 46. The nozzle plate 41 is joined to the pressure chamber plate 44 and to the piezoelectric element 43 such that the nozzle holes 42*a* to 42*d* correspond to the ink chambers 45*a* to 45*d*, respectively.

Figure 4:
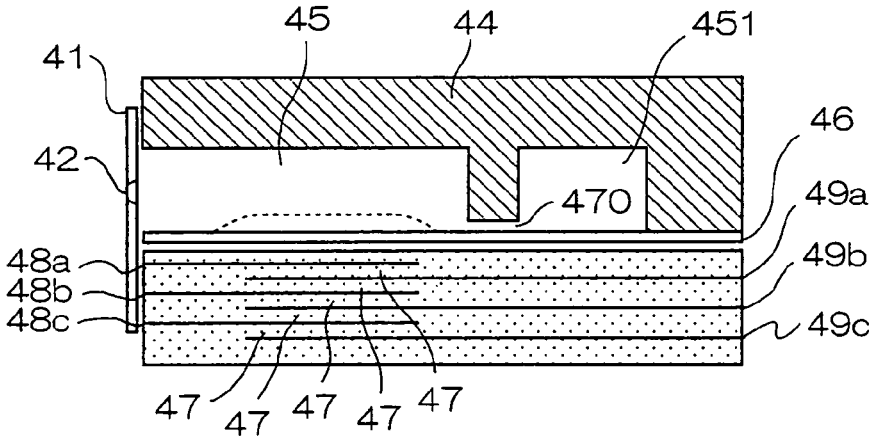
FIG. 4 is a sectional view of the ink-jet head in FIG. 1.

As shown in FIG. 4, in addition to the ink chamber 45, a common ink holder 451 and an ink supply path 470 are formed in the pressure chamber plate 44. Ink media are supplied, through the ink supply paths 470, from the common ink holder 451 to the ink chamber 45 of the nozzles.

On the piezoelectric element 43 serving as a means of pressure generation, common electrode layers 48*a* to 48*c* and independent electrodes 49*a* to 49*c* are stacked. When a voltage is applied to the electrodes, piezoelectric element layers 47*a* to 47*e* positioned between the electrodes are displaced, pressure is applied on the ink chamber 45, and ink particles are sprayed from the nozzle holes 42.

The ink-jet head 1-1 in FIGS. 3 and 4 is a piezoelectric type ink-jet head using a piezoelectric element as a means of pressure generation. However, a bubble type ink-jet head using a heat generation element as a means of pressure generation can also be applied.

Figure 5:
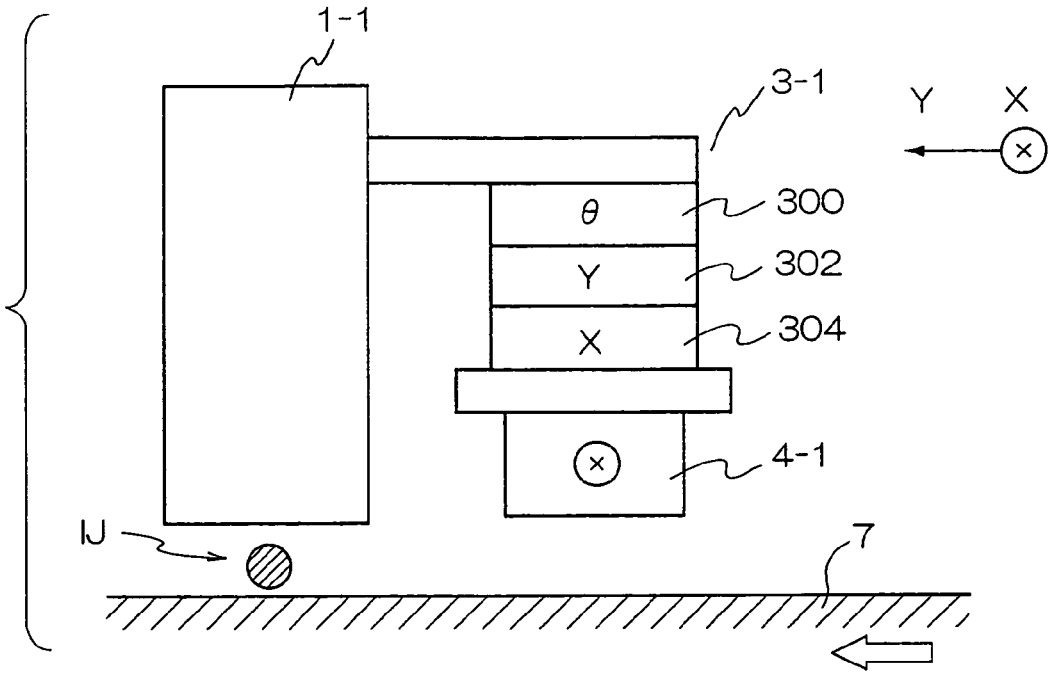
FIG. 5 is a diagram showing the configuration of a stage in FIG. 1.

FIG. 5 is a sectional view of the stage 3-1. The stage 3-1 has an X actuator 304 which is guided to the guide rail 4-1 to move the ink-jet head 1-1 in an extension direction X of the guide rail 4-1, a Y actuator 302 which is arranged on the X actuator 304 to move the ink-jet head 1-1 in a paper convey direction Y perpendicular to the direction X, and a θ actuator 300 which rotates the ink-jet head 1-1 on a paper surface. In FIG. 5, the ink-jet head 1-1 is fixed to the θ actuator 300 such that the surface of the nozzle (the nozzle plate 41 in FIGS. 3 and 4) is opposite to the sheet of paper 7.

Figure 8:
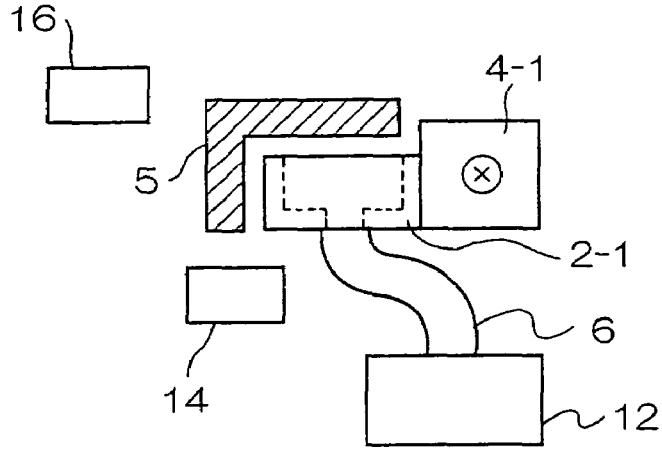
FIG. 8 is a diagram showing the configuration of a backup mechanism in FIG. 1.

FIG. 8 is a diagram showing a configuration of elements at the home position. At this position, are provided a cover 5 covering the cap 2-1, an opening/closing mechanism 16 which opens/closes the cover 5, a cap drive mechanism 14 which moves the cap 2-1 vertically, a purging pump 12 which performs purging inside the cap 2-1, and a discharge tube 6 which connects the cap 2-1 to the purging pump 12.

Figure 9:
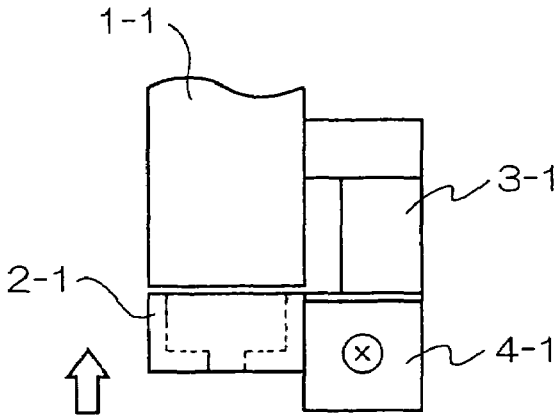
FIG. 9 is a diagram for explaining an operation of the backup mechanism in FIG. 8.

FIG. 1 shows a state in which the ink-jet heads 1-1 to 1-3 are located at home positions of the head. In a standby state, or in a long-term stationary state, the ink-jet heads 1-1 to 1-3 are moved back to home positions of the heads in a paper width direction, and, at the home positions of the head, as shown in FIG. 9, the surfaces of the nozzles of the ink-jet heads 1-1 to 1-3 are covered with the head caps 2-1 to 2-3, respectively.

In this manner, the surfaces of the nozzles and the holes of the nozzles of the ink-jet heads 1-1 to 1-3 are protected from external environmental factors such as drying and dust. Before printing, the ink-jet heads 1-1 to 1-3 spray inks from the holes of the nozzles in the direction of the head caps 2-1 to 2-3, respectively, to counter both clogging up of the nozzles and air bubbles, thereby refreshing meniscus surfaces of the nozzle. The ink-jet heads 1-1 to 1-3 accordingly move to printing positions on the upper surface of the sheet of paper 7.

FIG. 2 shows a state in which the ink-jet heads 1-1 to 1-3 have moved to printing positions of the heads. During printing, the ink-jet heads 1-1 to 1-3 are conveyed to printing positions of the heads, due to the stages 3-1 to 3-3 moving along the guide rails 4-1 to 4-3, respectively.

Figure 6:
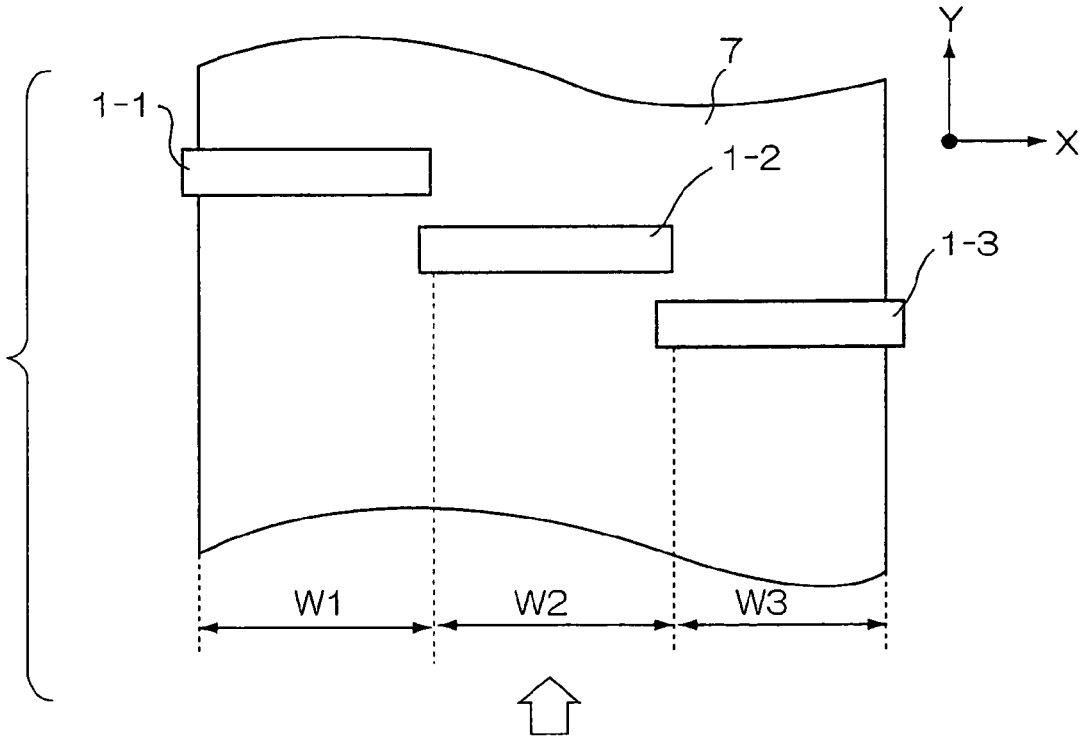
FIG. 6 is an upper view of FIG. 2 in a printing operation.

FIG. 6 shows printing positions of the ink-jet heads 1-1 to 1-3. In the examples in FIGS. 1 and 2, the three ink-jet heads are used. For this reason, the area of the sheet of paper 7 is divided into three regions W1 to W3 in a width direction, the ink-jet heads 1-1, 1-2, and 1-3 are positioned such that the ink-jet heads 1-1, 1-2, and 1-3 are responsible for the regions W1, W2, and W3, respectively. The ink-jet heads 1-1 to 1-3 are set in stationary states and perform printing for the corresponding printing regions W1 to W3.

For this reason, the ink-jet heads 1-1 to 1-3 have a number of nozzles, which corresponds to the widths of the regions and is based on a printing density. For example, it is assumed that a sheet of paper 7 is an 18-inch continuous form and that the printing density is 360 dpi. In this case, 6480 dots are required for printing the entire width of the sheet of paper 7. For this reason, the ink-jet heads 1-1 to 1-3 must respectively print 2160 dots, that is ⅓ of 6480 dots.

Specifically, in order to perform printing in the corresponding printing regions in a stationary state, the ink-jet heads 1-1 to 1-3 need to have a minimum of 2160 nozzles. This line of nozzles may be constituted by a single line or by a zigzag line. The number of heads and the number of nozzles on the heads are not limited to the above figures and can be appropriately selected on the basis of a printing density required, the width of the region corresponding to the paper, and the number of heads set.

Figure 7:
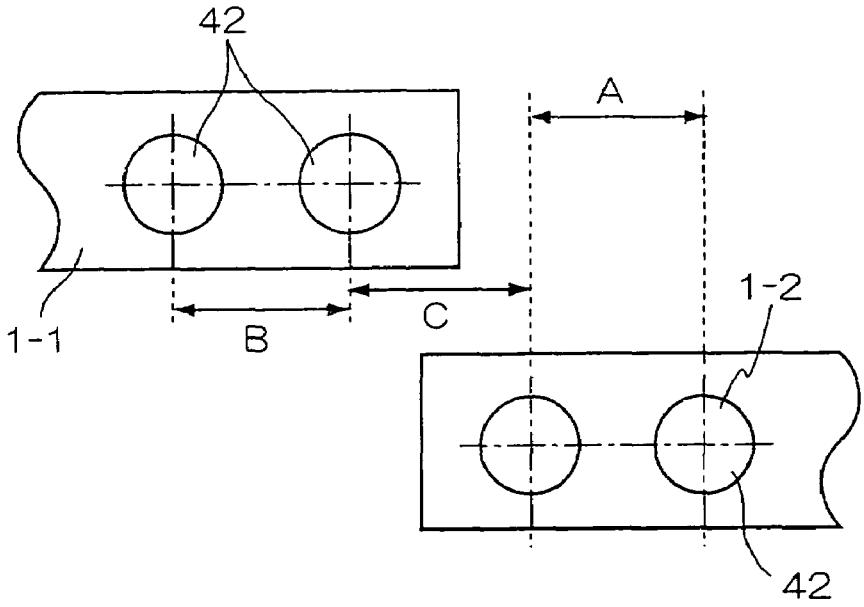
FIG. 7 is a view showing a positional relationship between the ink-jet heads of FIG. 6.

In addition, FIG. 7 shows configurations of nozzle pitches when viewed from surfaces of nozzles. A nozzle pitch B and a nozzle pitch C represent the nozzle pitches of the respective heads 1-1 and 1-2. When two or more heads are aligned as line type heads and are used, the nozzle pitches B and C are of equal length, unless there are special reasons otherwise.

Moreover, the printing positions of the heads 1-1 and 1-2 must be arranged such that the nozzle pitch C between heads is equal to the nozzle pitch B. Specifically, the printing positions of the ink-jet heads 1-1 to 1-3 are set to obtain a positional relationship between the nozzle holes 42, as shown in FIG. 7.

When the ink-jet heads 1-1 to 1-3 in FIG. 2 are located at printing positions, the head caps 2-1 to 2-3 are protected by the covers 5 shown in FIG. 8, simultaneous with the ink-jet heads 1-1 to 1-3 moving, such that the surfaces of the head caps, which surfaces are in contact with the surfaces of the nozzles of the ink-jet heads 1-1 to 1-3, are prevented from contamination by paper powder or the like, and that the insides of the cap are prevented from being affected by dust. Specifically, the cap 2-1 is moved down by the cap drive mechanism 14, and the upper surface of the cap 2-1 is covered with the cover 5 by means of the opening/closing mechanism 16. In this manner, surfaces of the nozzles and the holes of the nozzles of the ink-jet heads 1-1 to 1-3 can be protected from contamination, by means of avoiding contamination of the head caps 2-1 to 2-3.

In addition, as will be described below, when a defect in ink spray is detected during printing, the operations of the ink-jet heads 1-1 to 1-3 are rapidly stopped, and faulty ink-jet heads 1-1 to 1-3 are moved back to home positions by the stages 3-1 to 3-3, respectively. As shown in FIG. 9, at the home positions, the surfaces of the nozzles of the ink jet heads are covered with the head caps 2-1 to 2-3, respectively, and purging of discharging air bubbles or a recovery operation of spraying or the like are performed. Thereafter, the ink-jet heads 1-1 to 1-3 are again returned to the printing positions.

As shown in FIG. 8, the purging pump 12 is connected to the head caps 2-1 to 2-3 through the ink discharge tube 6, so that purging (a purging operation) can be undertaken by a controller, or by a pressure sensor, and the like, to execute a discharge sequence. In addition, inks in the spray operations of the heads are discharged from the head caps 2-1 to 2-3 by the discharge tube 6 to a waste ink tank arranged on the exterior of the head caps 2-1 to 2-3.

Figure 10:
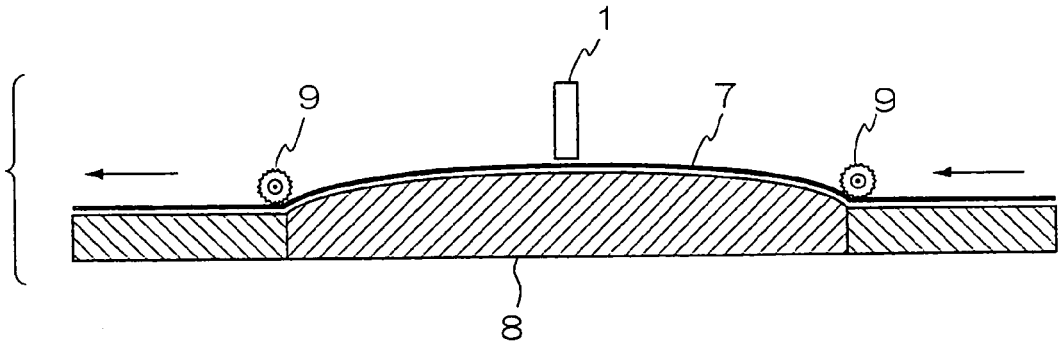
FIG. 10 is a sectional view of a paper tension plate in FIG. 1.
Figure 11:
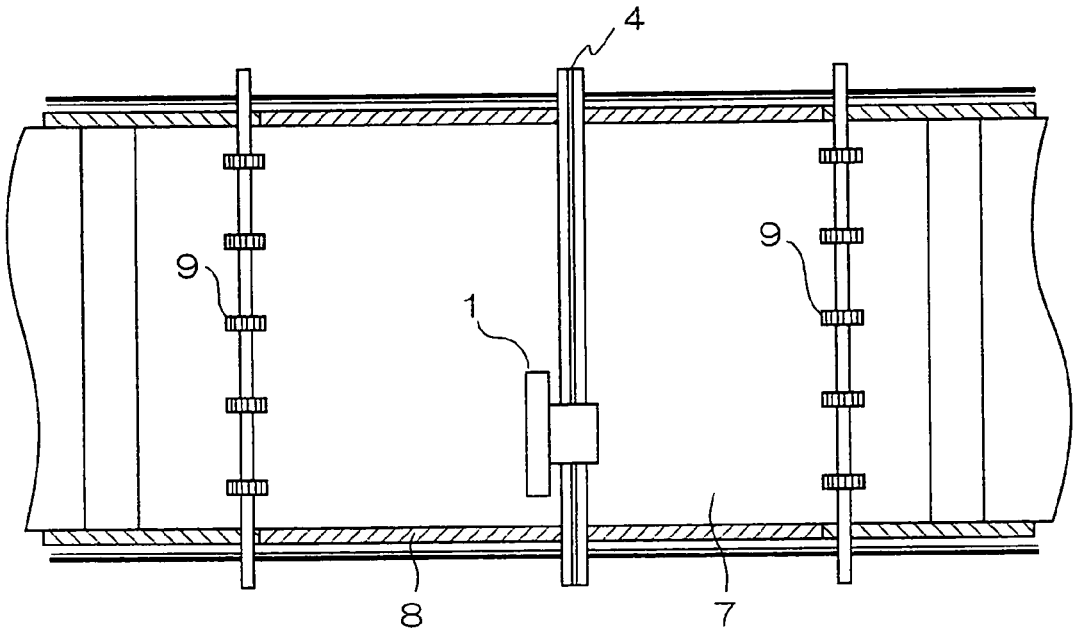
FIG. 11 is an upper view of the paper tension plate in FIG. 10.

FIGS. 10 and 11 are sectional and upper views of a paper tension plate of the ink-jet printer. In a printing region of an ink-jet head 1, when a clearance between the sheet of paper 7 and the surfaces of the nozzles of the ink-jet head 1 varies due to wrinkles in the paper, fluttering of the paper, or the like, ink dot diameters and dot pitches change, thus causing a deterioration in printing quality. In particular, when a sheet of folding paper is used as the sheet of paper 7, the clearance tends to change easily in a folding position such as a perforated line or the like.

In order to prevent clearance from being changed, a paper tension plate 8 having a convex conveyance surface is arranged under the ink-jet head 1 such that the sheet of paper 7 is always conveyed in a state of maintained tension. In addition, a pair of paper pressing rollers 9 are arranged at the front and rear of the convex portion in a paper conveyance direction such that the sheet of paper 7 is pressed against the conveyance surface (plate 8). The number of paper pressing rollers 9 and arrangement intervals between the paper pressing rollers 9, a pressing pressure, and the like are optimally set on the basis of the conditions of the apparatus.

Even when the sheets of folding paper (continuous forms) 7 are conveyed by the paper tension plate 8 at a high speed, print quality can be prevented from deteriorating, and increased speed can be provided for a line type ink-jet printer that has high reliability and is easy to maintain.

In this manner, a printing medium is divided into multiple regions in a width direction, multiple ink-jet heads are arranged to perform printing for the regions while remaining stationary, and the ink-jet heads are moved between home positions and printing positions set on the sides of the printing medium. For this reason, even in a full-line ink-jet printer, the surfaces of the nozzles of heads in stationary states can be prevented from becoming dry or being affected by dust, and a compact line type ink-jet printer with a high speed can be provided.

In the event of defects in spraying, the nozzles of heads can be recovered, and a highly reliable line type ink jet printer can be provided. Since an ink discharge mechanism is incorporated, a line type ink-jet printer can be provided which can be easily maintained. In addition, since a cover which protects the upper surface of a cap is arranged with a capacity to open and close, a highly reliable line type ink-jet printer can be provided in which heads can be prevented from becoming contaminated. Furthermore, since a conveyance surface is formed which maintains a clearance between the nozzle of a head and a printing medium, a line type ink-jet printer can be provided which can prevent printing quality from deteriorating and which produces a high quality of print.

[Image Forming Apparatus]

Figure 12:
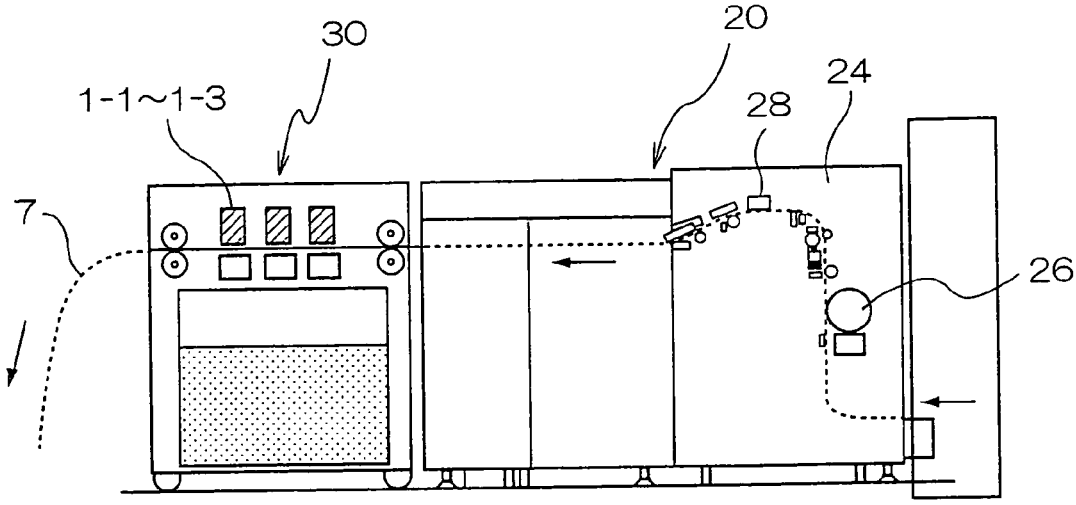
FIG. 12 is a diagram showing the configuration of a color image forming apparatus according to an embodiment of the invention.
Figure 13:
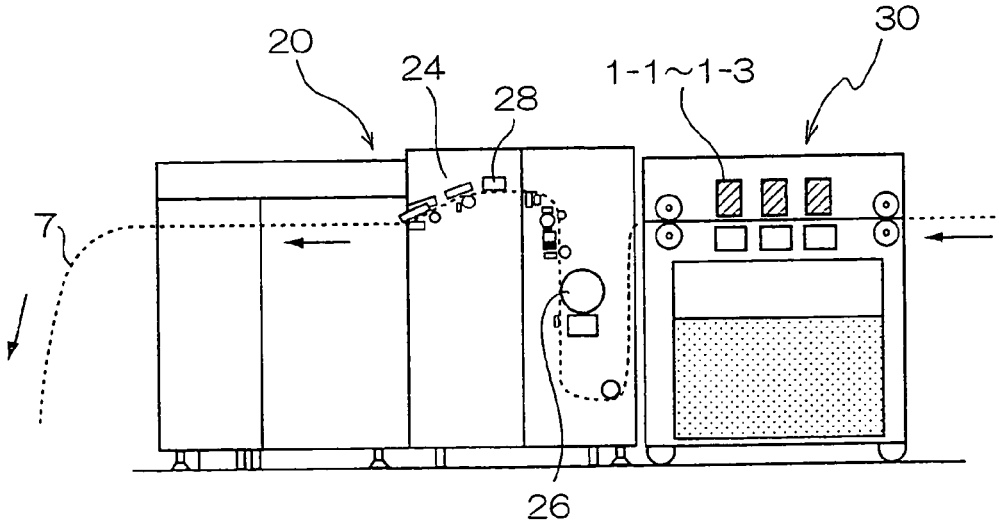
FIG. 13 is a diagram showing the configuration of a color image forming apparatus according to another embodiment of the invention.

FIG. 12 is a diagram showing a configuration of an image forming apparatus according to an embodiment of the invention. FIG. 13 is a diagram showing a configuration of an image forming apparatus according to another embodiment of the invention. As shown in FIGS. 12 and 13, the image forming apparatus comprises an electrophotographic page printer 20 and an ink-jet line printer 30, and performs color printing on continuous-form paper 7.

In FIG. 12, the ink-jet line printer 30 is arranged on the downstream side of the electrophotographic page printer 20. After the electrophotographic page printer 20 performs printing on the continuous-form paper 7 in a single color, the ink-jet line printer 30 performs printing in other colors on the continuous-form paper 7.

In FIG. 13, the ink-jet line printer 30 is arranged on the downstream side of the electrophotographic page printer 20. After the ink-jet line printer 30 performs printing on the continuous-form paper 7 in a single color, the electrophotographic page printer 20 performs printing in other colors on the continuous-form paper 7.

The electrophotographic page printer 20 is constituted by an electrophotographic engine 24 made up by a well known electrophotographic mechanism having a photosensitive drum 26. Specifically, in accordance with a known electrophotographic process, the electrophotographic engine 24 forms a toner image on the photosensitive drum 26, and transfers the toner image on the photosensitive drum 26 to the continuous-form paper 7 which is continuously fed by a tractor conveyance mechanism. The sheet of paper is subjected to heat or flash light by a fixing unit 28, and the toner on the paper 7 is melted and fixed on the paper 7.

The electrophotographic page printer 20 can perform printing at a high speed on the continuous-form paper 7. However, when multi-color printing is performed by an electrophotographic page printer, an electrophotographic mechanism including photosensitive drums of various colors must be arranged, thereby making the structure complex. In addition, since the positions of toners of various colors must be adjusted, high-speed printing cannot be performed easily.

On the other hand, the ink-jet line printer 30 has a simple structure, and high-speed printing can be performed within a short period of time. However, when continuous printing is performed, the states of the nozzles change depending on the frequences with which the nozzles spray inks. For this reason, a sequence for recovering the states of the nozzles is required, and in consequence high-speed continuous printing cannot easily be performed over a long period of time.

For this reason, in this embodiment, among the colors used for color printing, a color used for a large amount of print data is handled by the electrophotographic page printer 20, and a color used for a small amount of print data is handled by the ink-jet line printer 30, whereby high-speed color printing can be achieved. For example, printing in black can be performed by the electrophotographic page printer 20, and printing in red and blue can be performed by the ink-jet line printer 30. Preferably, in document printing, printing of characters or the like in black is performed by the electrophotographic page printer 20, and partial printing in red and blue is performed by the ink-jet line printer 30.

In the example in FIG. 12, since the ink-jet line printer 30 is arranged on the downstream side of the electrophotographic page printer 20, after the toner image is fixed on the paper 7, ink-jet printing is performed. For this reason, an ink image obtained by the ink-jet printing does not affect the transfer or the fixing of the toner image of the electrophotographic page printer 20.

Figure 14:
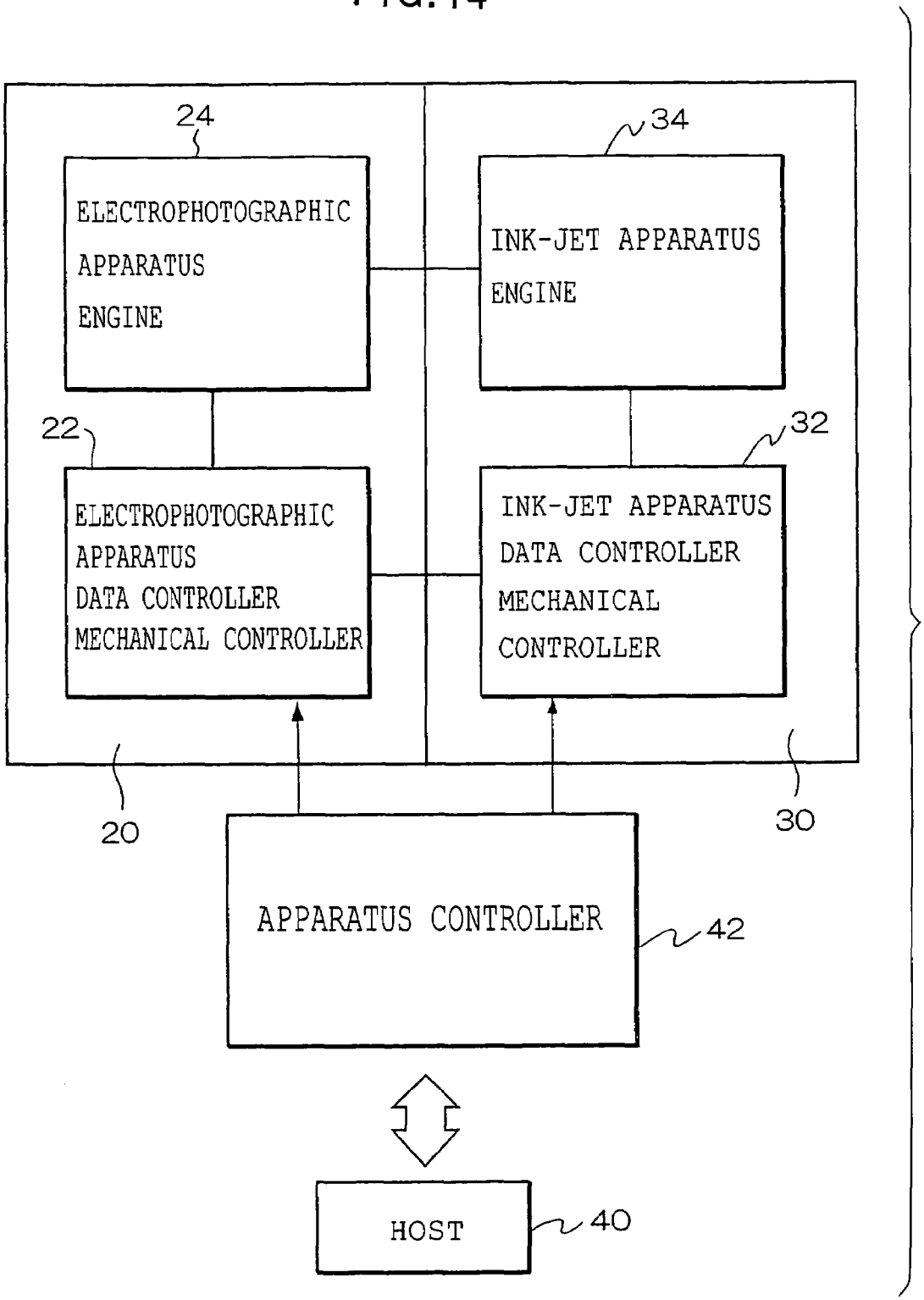
FIG. 14 is a block diagram of the color image forming apparatus according to the embodiment of the invention.

FIG. 14 is a block diagram of the image forming apparatus in FIG. 12. As shown in FIG. 14, the electrophotographic page printer 20 comprises the electrophotographic engine 24 in FIG. 12, an electronic mechanical controller 22 which controls the electrophotographic engine 24, and an apparatus controller 42 which controls the entire image forming apparatus.

On the other hand, the ink-jet line printer 30 comprises an ink-jet engine 34 (the ink-jet heads 1-1 to 1-3, the head caps 2-1 to 2-3, and the stages 3-1 to 3-3 in FIG. 1) and an ink-jet controller 32 which controls the ink-jet engine 34.

The apparatus controller 42 is connected to a host computer 40, and receives from the host computer 40 a printing instruction, to develop the printing instruction into bitmap data. The apparatus controller 42 transfers to the ink-jet controller 32 bitmap data to be printed by the ink-jet engine 34 (bitmap data of a color to be printed). The ink-jet controller 32 controls ink-jet engine 34 on the basis of the bitmap data and prints an image on the paper 7.

The apparatus controller 42 transfers to the electrophotographic mechanical controller 22 bitmap data to be printed by the electrophotographic engine 24 (bitmap data of a color to be printed). The electrophotographic mechanical controller 22 controls the electrophotographic engine 24 on the basis of the bitmap data, and prints an image on the paper 7.

In this manner, an ink-jet line printer is added to an electrophotographic printer which performs high-speed printing, and color printing can be easily performed while high-speed printing is maintained by the electrophotographic printer.

[Control of Ink-Jet Line Printer]

Control of the ink-jet line printer will next be described in the following order: during activation of the apparatus, during activation of printing, during spraying, at the end of a printing job and during detection of nozzles which are not spraying. All these operations are executed by the ink-jet controller 32 shown in FIG. 14.

Figure 15:
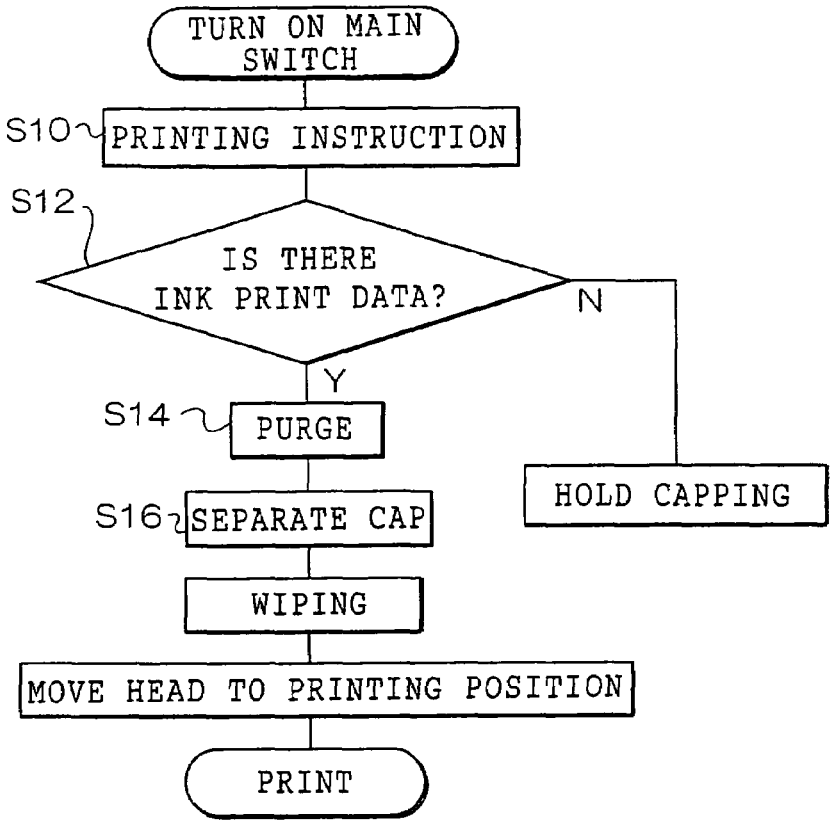
FIG. 15 is a control flow chart of the ink-jet line printer according to the invention during activation of the apparatus.

FIG. 15 is a control flow chart of the ink-jet line printer according to the invention during activation of the apparatus.

(S10) When a main switch is turned on, the ink-jet line printer waits for a printing instruction.

(S12) When the ink-jet line printer receives the printing instruction, the ink-jet line printer decides whether or not the printing instruction includes ink print data (data to be printed by ink-jet heads). When the printing instruction does not include ink print data, holding of capping is maintained. Specifically, as shown in FIG. 1, in a condition such as a standby state or a long-term stationary state, the ink-jet heads 1-1 to 1-3 are moved back to home positions of the head in a paper width direction, and the surfaces of the nozzles of the ink-jet heads 1-1 to 1-3 are covered with the head caps 2-1 to 2-3, respectively at the home positions of the head, as shown in FIG. 9. In this manner, the surface of nozzles and the holes of nozzles of the ink-jet heads 1-1 to 1-3 are protected from external environmental factors such as drying and dust.

(S14) On the other hand, when the printing instruction includes ink print data, purging of the insides of the head caps 2-1 to 2-3 covering the surfaces of the nozzles of the ink-jet heads 1-1 to 1-3 is performed by the purging pump 12, and the inks are forcibly purged from the nozzles of the ink-jet heads 1-1 to 1-3. This is called a purging operation. Specifically, even when capping is held, when the ink-jet line printer is not driven for a predetermined period of time, there is a risk that the nozzles may become clogged up. For this reason, inks are forcibly purged from the nozzles to counter the clogging up of the nozzles.

(S16) After purging has been performed for a predetermined period of time, as shown in FIG. 8, the head caps 2-1 to 2-3 are separated from the surfaces of the nozzles of the ink-jet heads 1-1 to 1-3, respectively. As shown in FIG. 2, the ink-jet heads 1-1 to 1-3 are moved to printing positions on the upper surface of the paper 7. At this time, the surfaces of the nozzles of the ink-jet heads 1-1 to 1-3 are wiped out (a process called wiping) by wipers 70 arranged at the ends of the head caps 2-1 to 2-3, and the surfaces of the nozzles are cleaned.

Specifically, as shown in FIG. 2, the ink-jet heads 1-1 to 1-3 are conveyed to the printing positions of the heads by moving the stages 3-1 to 3-3 along the guide rails 4-1 to 4-3, respectively. At the printing positions, the ink-jet heads 1-1 to 1-3 stop to print the ink print data.

A transition process from a standby state to a printing state will be described below in accordance with FIG. 16.

(S20) In the standby state in FIG. 1, when the ink-jet line printer receives a printing instruction, the ink-jet line printer decides whether or not the printing instruction includes ink print data (data printed by the ink-jet heads). When the printing instruction does not have ink print data, capping holding is maintained. Specifically, as shown in FIG. 1, in a condition such as a standby state or a long-term stationary state, the ink-jet heads 1-1 to 1-3 are moved back to home positions of heads in a paper width direction, and at the home position of the heads, as shown in FIG. 9 the surfaces of the nozzles of the ink-jet heads 1-1 to 1-3 are covered with the head caps 2-1 to 2-3, respectively. In this manner, the surfaces of nozzles and the holes of nozzles of the ink-jet heads 1-1 to 1-3 are protected from external environmental factors such as drying and dust.

(S22) On the other hand, when the printing instruction includes the ink print data, the head caps 2-1 to 2-3 covering the surfaces of the nozzles of the ink-jet heads 1-1 to 1-3 are separated from the surfaces of the nozzles of the ink-jet heads 1-1 to 1-3. The nozzles of the ink-jet heads 1-1 to 1-3 are driven to spray ink particles (a process called spraying). Specifically, before printing, ink particles are sprayed from the nozzles to initialize the states of the holes of the nozzles.

(S24) As shown in FIG. 2, the ink-jet heads 1-1 to 1-3 are conveyed to printing positions of the heads by moving the stages 3-1 to 3-3 along the top of the guide rails 4-1 to 4-3, respectively. At the printing positions, the ink-jet heads 1-1 to 1-3 stop to print the ink print data.

A spraying process in printing will be described below in accordance with FIG. 17.

Figure 16:
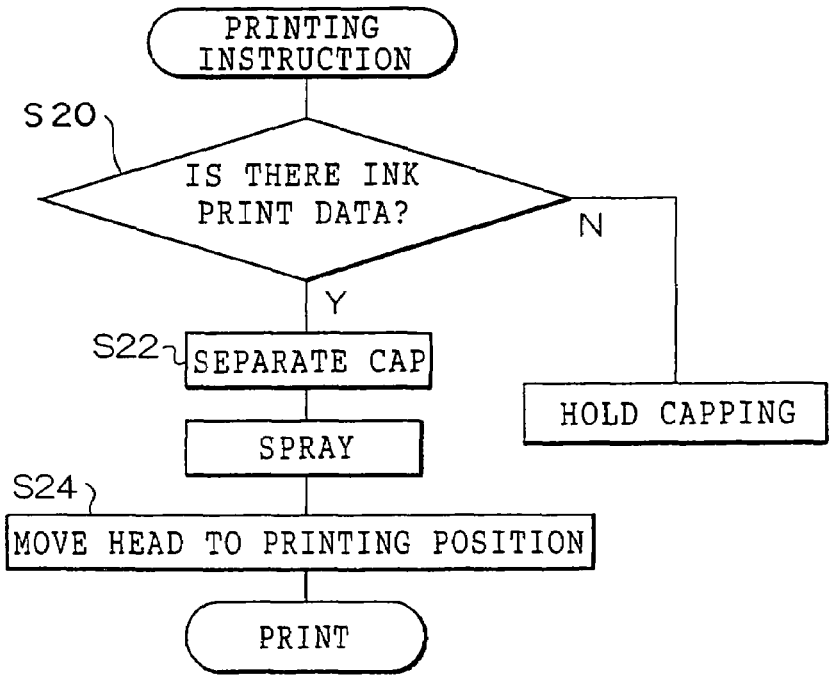
FIG. 16 is a control flow chart of the ink-jet line printer according to the invention during activation of printing.

(S30) As shown in FIGS. 15 and 16, while the ink-jet heads 1-1 to 1-3 stop at printing positions to perform printing of ink print data, a continuous printing time for the ink-jet heads 1-1 to 1-3 is measured, and it is decided whether the continuous printing time is Y minutes or more. Specifically, when the ink-jet heads 1-1 to 1-3 are continuously driven, the frequencies with which the nozzles are driven vary depending on the ink print data, and some nozzles are not driven at all. If such nozzles are allowed to be idle for a long period, while other nozzles are driven continuously, the idle nozzles may become clogged up, or air bubbles may be generated. For this reason, a period of continuous printing is regulated within the predetermined Y minutes.

(S32) When a continuous printing time exceeds Y minutes, printing is completed in units of formats (pages). As shown in FIG. 1, the ink-jet heads 1-1 to 1-3 are moved back by the stages 3-1 to 3-3 to the home positions of the heads in a paper width direction.

(S34) In a state in which the head caps 2-1 to 2-3 are separated from the surfaces of the nozzles of the ink-jet heads 1-1 to 1-3, the nozzles of the ink-jet heads 1-1 to 1-3 are driven and ink particles are sprayed out from each nozzle. Specifically, after continuous printing for a predetermined time, ink particles are sprayed from the nozzles to initialize the states of the holes of the nozzles.

(S36) As shown in FIG. 2, the ink-jet heads 1-1 to 1-3 are moved back by the stages 3-1 to 3-3 to the printing positions of the heads along the top of the guide rails 4-1 to 4-3, respectively. At the printing positions, the ink-jet heads 1-1 to 1-3 stop to restart printing of the ink print data.

Figure 18:
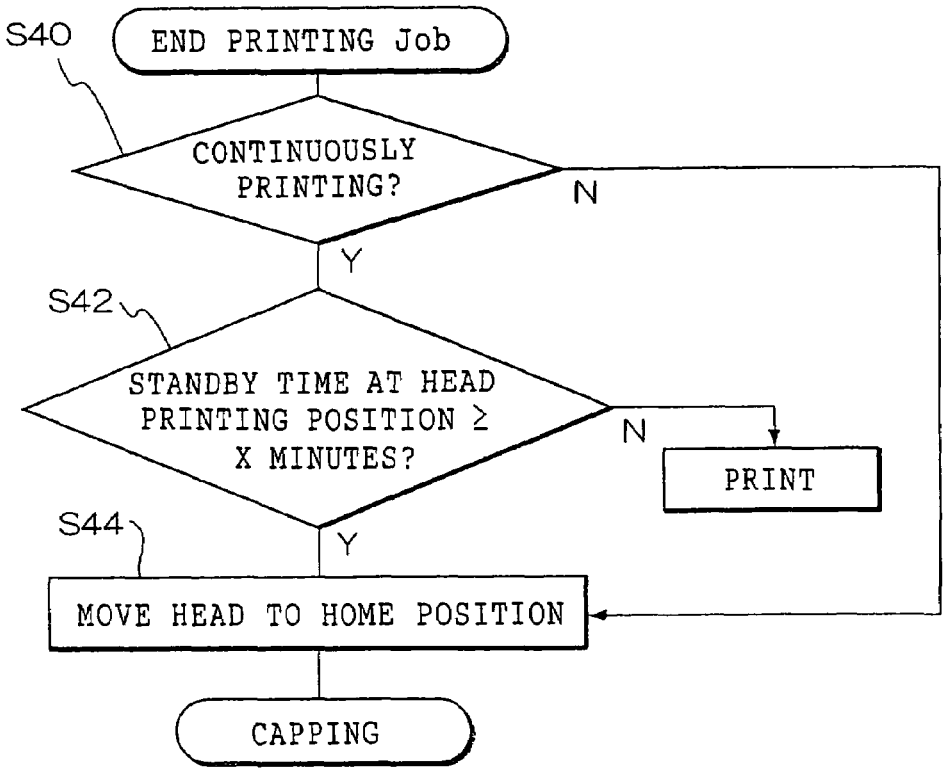
FIG. 18 is a control flow chart of the ink-jet line printer according to the invention at the end of a printing job.

A process at the end of a printing job will be described below with reference to FIG. 18.

Figure 17:
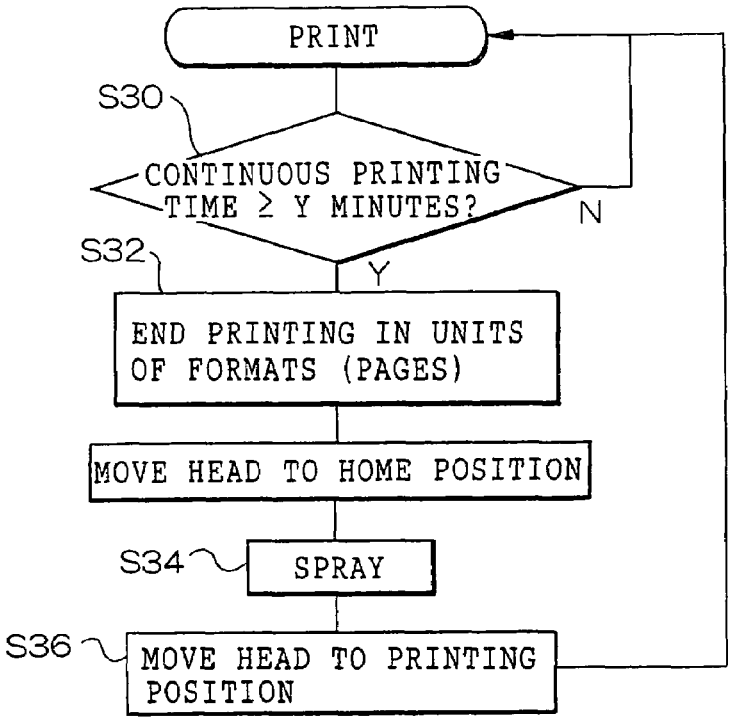
FIG. 17 is a control flow chart of the ink-jet line printer according to the invention during a spray operation.

(S40) In FIGS. 15, 16, and 17, at the printing positions, the ink-jet heads 1-1 to 1-3 stop to print the ink print data. When one printing job has been completed, it is determined whether or not to proceed to the next job by continuing with printing the ink print data. For example, when notice of a printing schedule is received from an operator or from a host computer of the printer, it can be determined whether or not to proceed to the next job and continue printing the ink print data. When printing is not to be continuously performed, the control flow shifts to step S44.

(S42) When printing is to be continuously performed, it is determined from the printing schedule whether or not a standby time of a head at a printing position of the head is X minutes or longer before the starting time of the next job. When a standby time is long, there is a risk of the nozzles becoming clogged up due to drying or the like. For this reason, the standby time is limited to a predetermined period, i.e., X minutes. When the standby time does not exceed X minutes, the heads remain on standby at printing positions, and after the standby time has elapsed, printing is connected.

(S44) When the standby time exceeds the X minutes, as shown in FIG. 1, the ink-jet heads 1-1 to 1-3 are moved back by the stages 3-1 to 3-3, respectively, to the home positions of the heads in a paper width direction. The head caps 2-1 to 2-3 are brought into contact with the surfaces of the nozzles of the ink-jet heads 1-1 to 1-3, respectively, to cap the nozzles of the ink-jet heads 1-1 to 1-3, in order to protect the nozzles from drying and dust.

Figure 19:
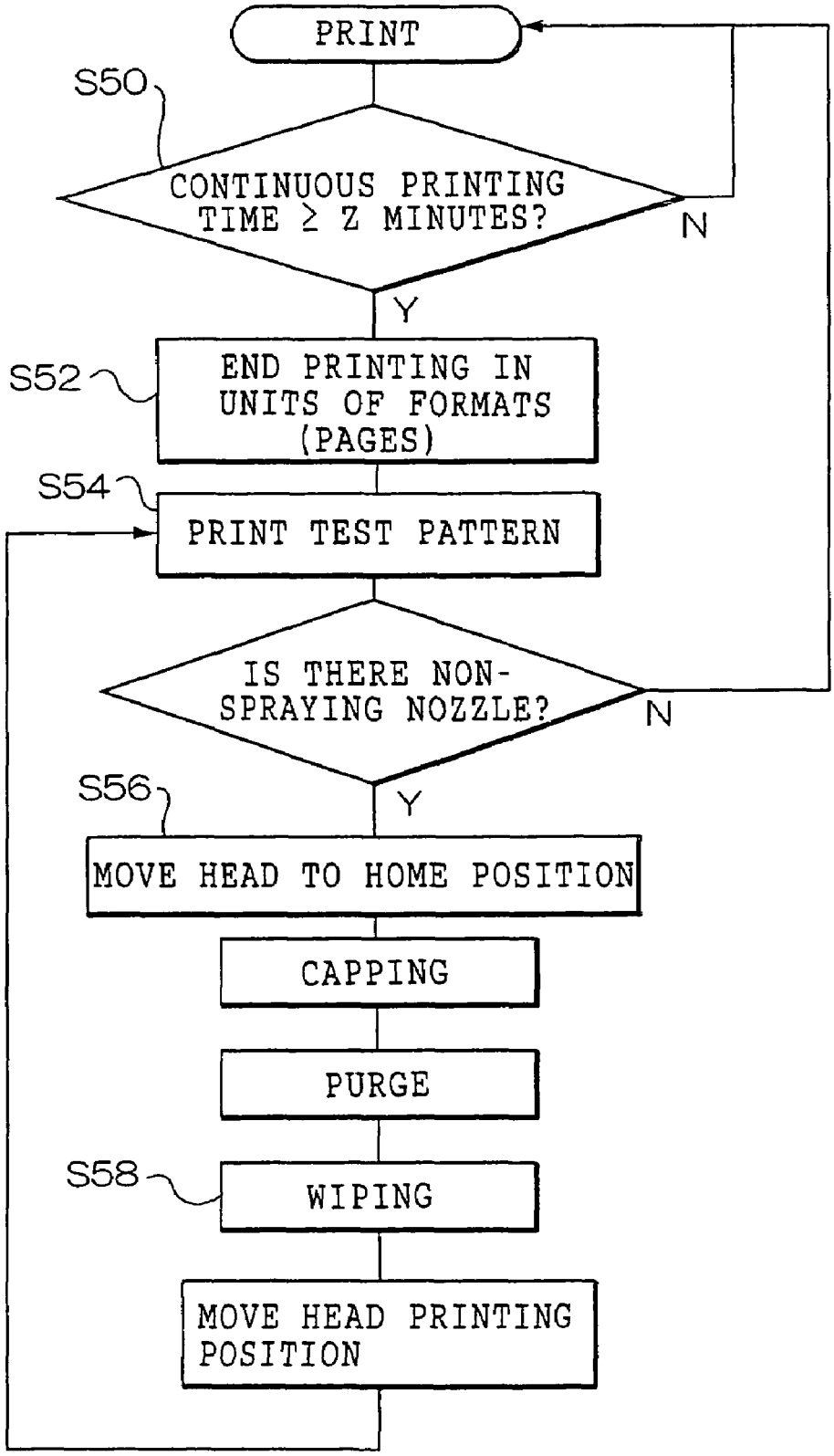
FIG. 19 is a control flow chart of the ink-jet line printer according to the invention during a clogging test.

Detection and recovery processes for a nozzle which is not spraying will be described below with reference to FIGS. 19 and 20.

(S50) In FIGS. 15 to 18, while the ink-jet heads 1-1 to 1-3 are stationary at printing positions to print the ink print data, continuous printing time for the ink-jet heads 1-1 to 1-3 is measured, and it is determined whether the continuous printing time is a predetermined Z (Z>Y) minutes or longer. Specifically, when the ink-jet heads 1-1 to 1-3 are continuously operated, the frequencies with which the nozzles are driven vary, depending on the ink print data, and some nozzles are not driven at all. if such nozzles are allowed to be idle for a long time, while other nozzles are continuously operated, there is a risk of the idle nozzle becoming clogged up. For this reason, a continuous printing time is limited to the predetermined period, i.e., Z minutes.

(S52) When the continuous printing time exceeds Z minutes, printing is completed in units of formats (pages).

(S54) Next, the ink-jet heads 1-1 to 1-3 are made to print a test pattern. For example, all the nozzles are driven. As shown in FIG. 20, a line sensor 18 is arranged on the upstream side of the paper 7 in the conveyance direction. The line sensor 18 detects ink dots on all the nozzles on the paper 7 and performs photo-electric conversion. On the basis of a photoelectric conversion output, the ink-jet controller 32 described above determines whether or not inks have been sprayed from all the nozzles. Specifically, the ink-jet controller 32 determines whether or not there is a nozzle which has not been spraying ink. When a nozzle that has not been spraying ink does not exist, the control flow returns to step S50 in order to recommence printing.

(S56) On the other hand, when a nozzle does exist which has not been spraying ink, only the ink-jet heads 1-1 to 1-3 that have such a nozzle are moved back by the stages 3-1 to 3-3, respectively, to the home positions of the heads in a paper width direction. The head caps 2-1 to 2-3 are brought into contact with the surfaces of the nozzles of the ink-jet heads 1-1 to 1-3, purging of the insides of the head caps 2-1 to 2-3 is performed by the purging pump 12 and the inks are forcibly purged from the nozzles of the ink-jet heads 1-1 to 1-3. Specifically, when a nozzle is clogged up, forcible purging is performed to eliminate the clogging up of the nozzle.

(S58) After purging has been performed for a predetermined period of time, as shown in FIG. 8, the head caps 2-1 to 2-3 are separated from the surfaces of the nozzles of the ink-jet heads 1-1 to 1-3, respectively. As shown in FIG. 2, the ink-jet heads 1-1 to 1-3 are moved to printing positions on the upper surface of the paper 7. At this time, the surfaces of the nozzles of the ink-jet heads 1-1 to 1-3 are wiped out by the wipers 70 arranged at the ends of the head caps 2-1 to 2-3 (a process called wiping) shown in FIG. 2, and the surfaces of the nozzle are cleaned.

Specifically, as shown in FIG. 2, the ink-jet heads 1-1 to 1-3 are conveyed by the stages 3-1 to 3-3 moving along the top of the guide rails 4-1 to 4-3, respectively, to printing positions of the heads. The control flow returns to step S54 to print again a test pattern at the printing positions. This operation is repeated until such time as a nozzle which is not spraying ink no longer exists.

Figure 20:
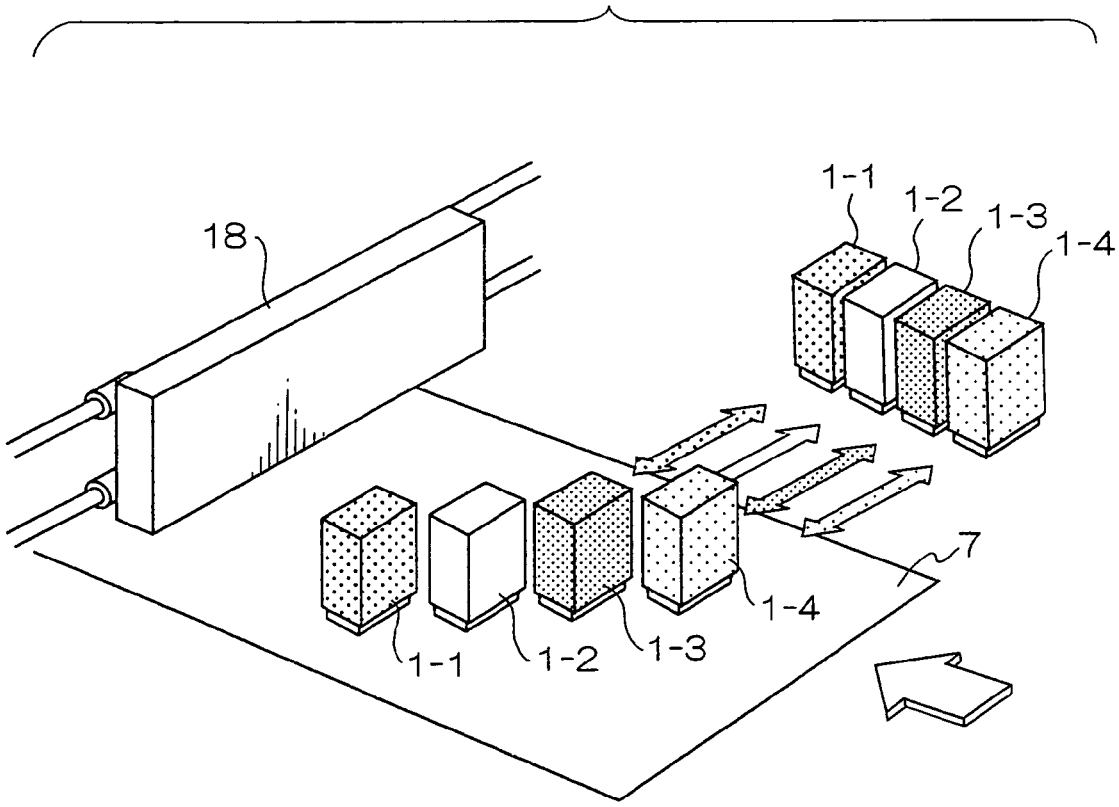
FIG. 20 is a diagram showing the configuration of an ink-jet line printer which performs the operation of FIG. 19.

The line sensor 18 in FIG. 20 may, in order to detect results of printing in regions in a width direction of the papers, be a line sensor having a width equal to the paper width 7, or alternatively may be a line sensor having a width equal to or smaller than the paper width, which can move in the paper width direction. Further, the test pattern may be printed over not only a single line but also over multiple lines. When the test pattern is printed over multiple lines, the test pattern may be printed to cover only every other nozzle which is being driven. In this manner, printing, protection, and recovery control of the ink-jet heads constituting the line printer are performed by making use of printing positions and home positions.

[Another Ink-Jet Line Printer]

Figure 21:
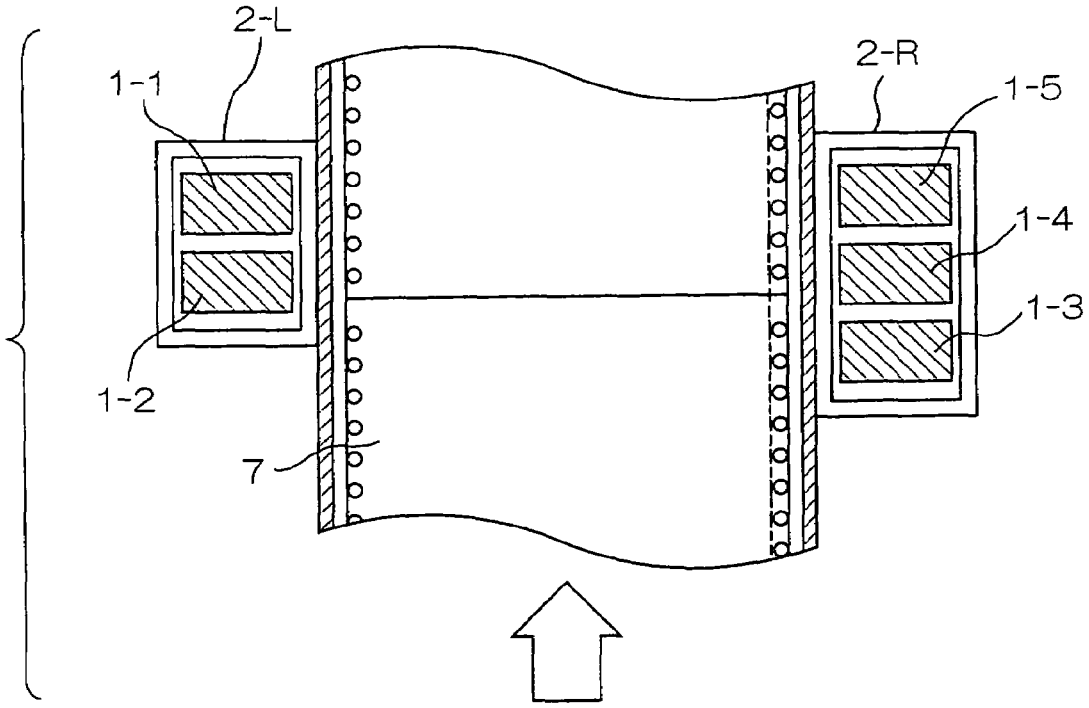
FIG. 21 is a diagram showing the configuration of an ink-jet line printer according to another embodiment of the invention.
Figure 22:
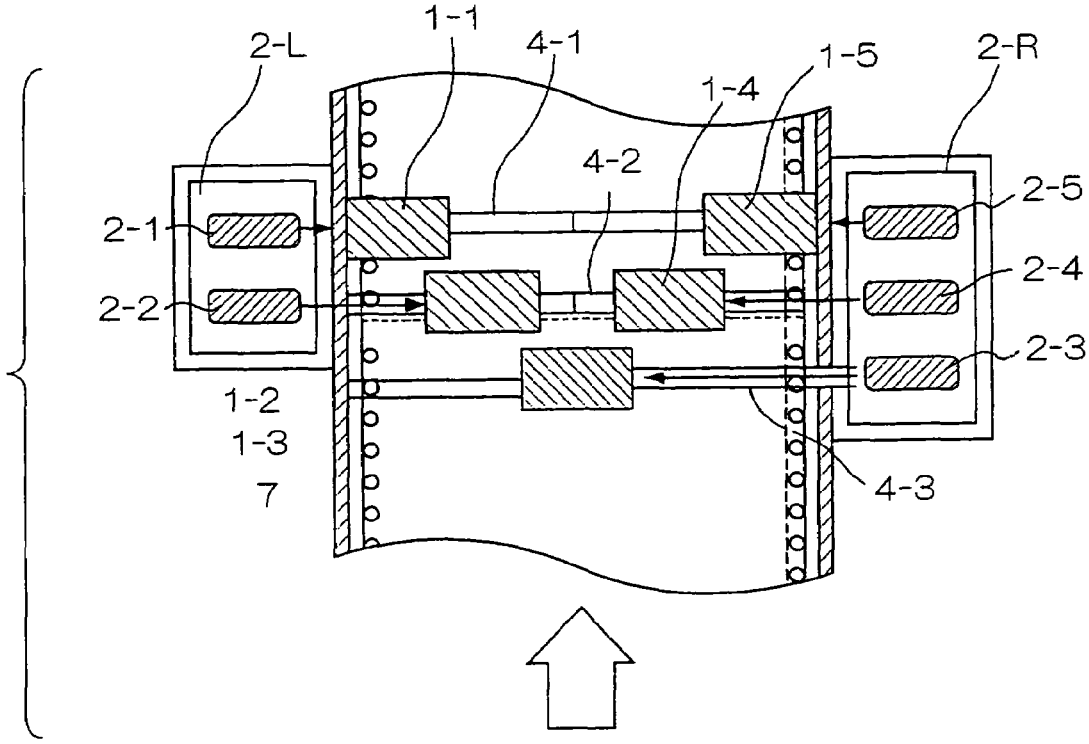
FIG. 22 is a diagram for explaining an operation of the ink-jet line printer in FIG. 21.

FIGS. 21 and 22 are upper views of another embodiment of a ink-jet line printer according to the invention. FIG. 21 shows a state in which heads are located at home positions, and FIG. 22 shows a state in which heads are located at print positions.

In this embodiment, home positions for the heads are set on both sides of the paper 7. Specifically, as shown in FIG. 21, home positions (cap mechanisms) 2-L for the ink-jet heads 1-1 and 1-2 are set on the left side of the paper 7, and home positions (cap mechanisms) 2-R for the heads 1-3, 1-4, and 1-5 are set on the right side of the paper 7.

As shown in FIG. 22, at the print positions, the ink-jet heads 1-1 and 1-5 are set at the left and right ends of the paper 7 along the guide rail 4-1, the ink-jet head 1-3 is set at the center of the paper 7 along the guide rail 4-3, and the ink-jet heads 1-2 and 1-4 are set at positions between the center and the left and right ends, respectively, along the guide rail 4-2.

With the above configuration, five ink-jet heads can be arranged in regions arranged in the paper conveyance direction, as shown in FIG. 1. Assuming that a sheet of paper 7 is an 18-inch continuous form and that the printing density is 360 dpi, 6480 dots are required for printing the entire width of the sheet of paper 7. In this case, therefore, the number of nozzles on each of the ink-jet heads 1-1 to 1-5 may be 1296, equal to ⅕ of the 6480 dots. Specifically, even when ink-jet heads with a small number of nozzles are used, which can be easily manufactured, the area occupied by the apparatus as a whole is prevented from being increased.

In addition, when the ink-jet heads have multiple colors and the ink-jet heads having nozzles, arranged in multiple lines, for spraying inks of multiple colors are to be mounted, the above configuration is advantageous in the sense that it obviates the necessity for an increase in scale of the apparatus.

[Control for Alternating Arrangement of an Ink-Jet Head]

In the ink-jet line printer, arrangements of ink-jet heads at printing positions are controlled in order to spread out the loads placed on individual nozzles. Since the life spans of ink-jet heads are determined by the number of times that the nozzles are driven, when individual nozzles are frequently driven, the life spans of the heads themselves are correspondingly shortened.

In the ink-jet line printer according to the invention, advantage is taken of the fact that the ink-jet heads can be moved in the width direction of the paper, thus alternating the arrangements of the heads and spreading out loads.

Figure 23A:
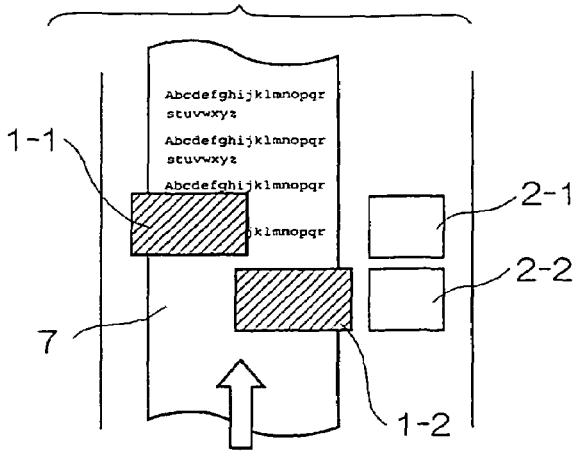
FIG. 23 is a diagram for explaining alternating control of a head arrangement of the ink-jet line printer according to the invention.
Figure 23B:
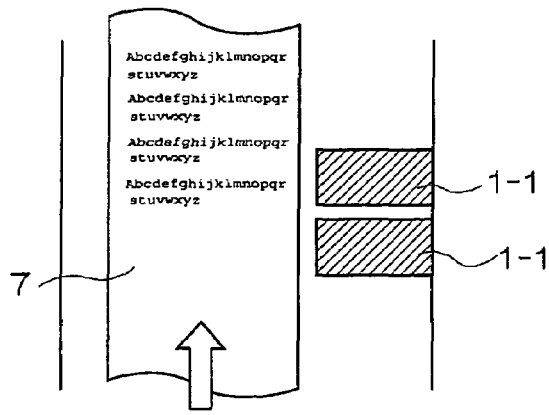
Figure 23C:
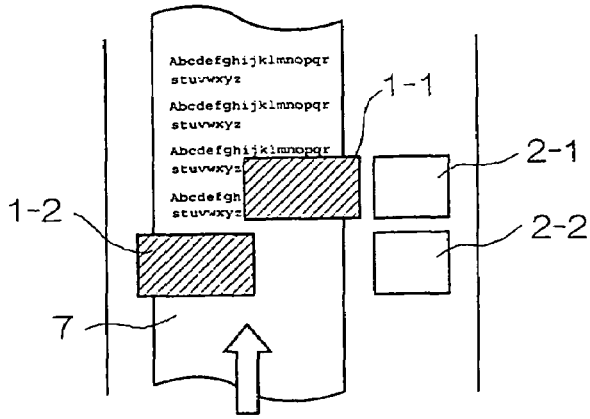

FIGS. 23A to 23C are diagrams illustrating arrangements for alternating control of the ink-jet heads according to the invention. FIG. 23A shows a line printer in which two ink-jet heads 1-1 and 1-2 are arranged to cover the entire paper width. Heads with the same specifications are used for the heads 1-1 and 1-2. The heads 1-1 and 1-2 are arranged such that the heads 1-1 and 1-2 print images in both the left and the right regions, respectively in the paper conveyance direction, so that the heads 1-1 and 1-2 cover printing over the entire area of the paper 7.

In FIG. 23C, the arrangements of the heads 1-1 and 1-2 are alternated, with the ink-jet head 1-1 printing an image in the right region in the paper conveyance direction, and the ink-jet head 1-2 printing an image in the left region. At a certain point in time, the arrangements illustrated in FIG. 23A are modified into the arrangements of heads illustrated in FIG. 23C, so that loads on specific nozzles (heads) returned to printing regions are spread out, and an apparatus with a long life span can be obtained. As an alternative timing, it is effective that, when the heads 1-1 and 1-2 have moved to home positions, as shown in FIG. 23B, and then return to printing positions, the positions of the heads are changed, as shown in FIG. 23C.

For example, when the heads are arranged in the initial state, as illustrated in FIG. 23A, a predetermined pattern is printed. As shown in FIG. 23B, the heads 1-1 and 1-2 move to home positions for a spray operation in the middle of printing, or to protect a head after the end of printing. When the heads return from home positions to positions corresponding to the printing state, in order to reduce the load on any given nozzle, in the light of the number of times that the nozzles have been used for spraying, and of pattern data ready for printing, the positions of the heads 1-1 and 1-2 are alternated as shown in FIG. 23C, and printing is started. When it appears that a load is no longer acting on the nozzle in question, as shown in FIG. 23A, printing may be performed in the initial state.

Figure 24:
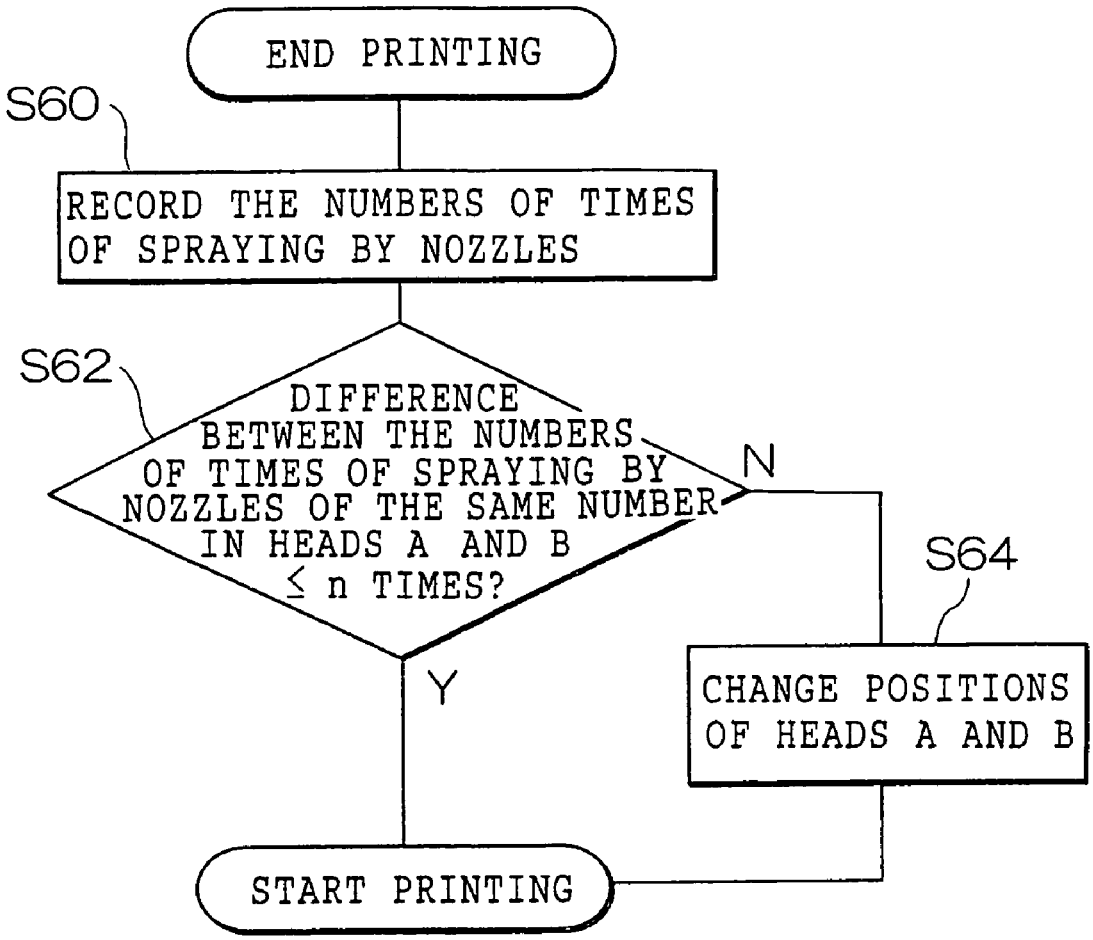
FIG. 24 is a flow chart of an alternating control process of the ink-jet line printer arrangement in FIG. 23.

FIG. 24 is a control flow chart of arrangements for alternating control of a head according to an embodiment of the invention.

(S60) The numbers of times during one job that the nozzles of the heads 1-1 and 1-2 have been used for spraying are measured during printing. After printing of one job has been completed, the number of times that each nozzle has been used for spraying is recorded.

(S62) Variations are calculated between the previous printing job and the current printing job, of the number of times that spraying has been performed by nozzles of the same position numbers in the heads 1-1 and 1-2 (the same positions in the heads). It is then determined whether or not a difference in the number of times that spraying has been performed is a set number of spraying times, i.e., "n" or more or not. When the difference between the number of spraying times is smaller than "n", the next job is printed with the existing arrangements of heads.

(S64) When the difference between the number of spraying times is "n" or more, the printing positions of the heads 1-1 and 1-2 are alternated at the start of the subsequent printing.

Figure 25:
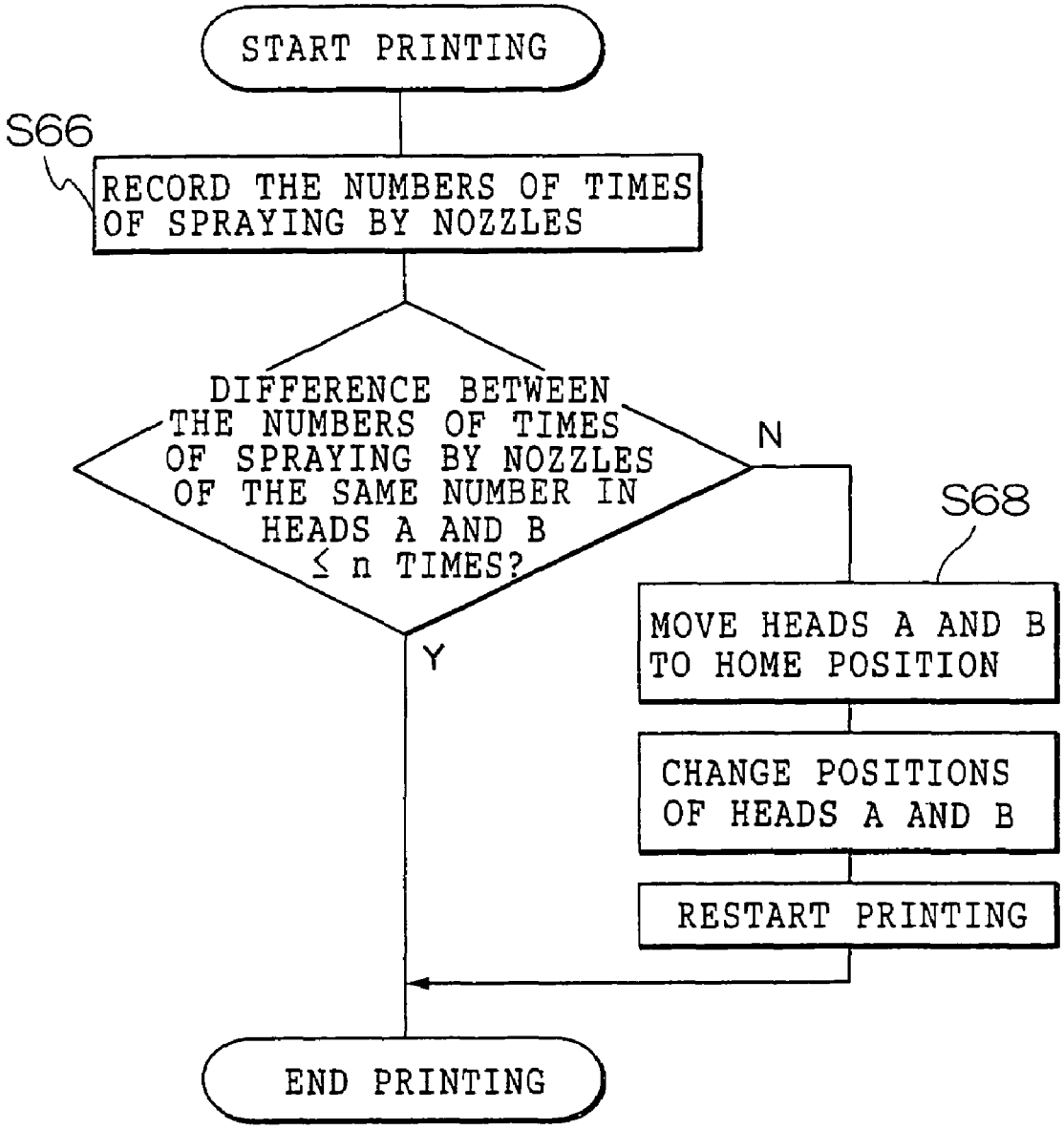
FIG. 25 is a flow chart of another alternating control process of the ink-jet line printer arrangement in FIG. 23.

FIG. 25 is a control flow chart of arrangements for alternating control of heads according to another embodiment of the invention.

(S66) During the printing of one job, the number of times that the nozzles of the heads 1-1 and 1-2 have been used for spraying is measured as and when necessary. Variations between numbers of times that nozzles of the same position number in the heads 1-1 and 1-2 (the same positions in the heads) have effected spraying are calculated as and when necessary during printing, and each time it is determined whether a difference between numbers of spraying times is a set number of spraying times, i.e. n or more. When a difference between the number of spraying times is smaller than "n", the next job is printed with the existing arrangements of heads.

(S68) When the number of times that nozzles of the same position number have been used for spraying is a set number of spraying times, i.e. n or more, the heads 1-1 and 1-2 are moved to home positions. The printing positions are then alternated, and printing is restarted. When a timing at which the heads 1-1 and 1-2 move to the home positions coincides with times at which spraying is periodically performed, a loss of printing time can be advantageously eliminated.

Figure 26:
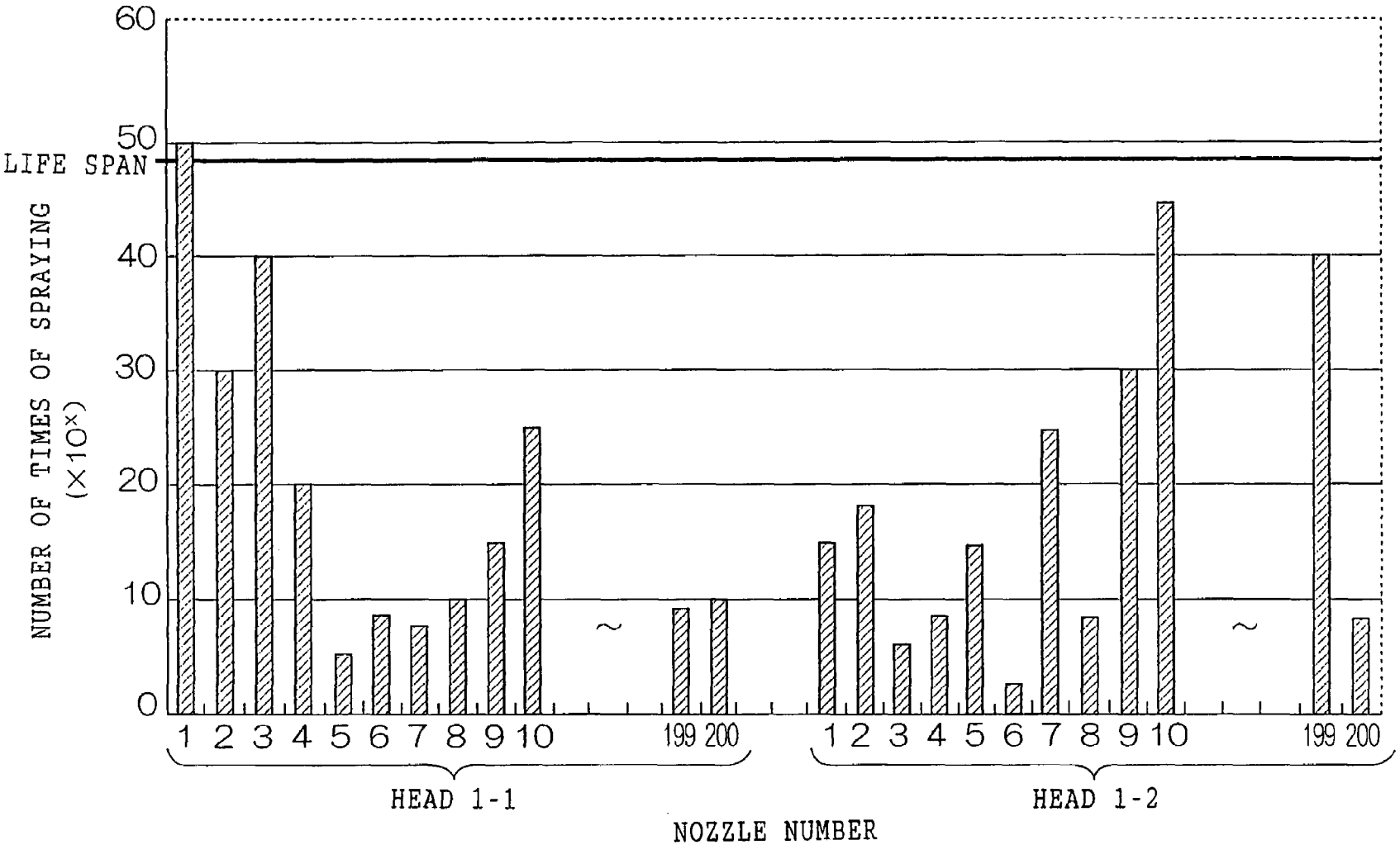
FIG. 26 is a spraying distribution diagram of the nozzles for explaining an operation of alternating control of the ink-jet line printer arrangement in FIG. 23.

FIG. 26 is a graph showing a distribution of the numbers of occasions that each nozzle of each head has been used for spraying during printing, in circumstances where the positions of the heads 1-1 and 1-2 have not been alternated. As far as the head 1-1 is concerned, for example, the number of times that nozzles Nos. 5 and 6 were used for spraying is extremely small, but, on the other hand, the number of times that nozzle No. 1 was used for spraying is large, exceeding a set value of a life span (in this case, 49 billion). For this reason, the head must be replaced. As for the head 1-2, in the case of all the nozzles the number of times that nozzles were used for spraying did not attain the set value of a life span, and the number of times that nozzle No. 1 was used for spraying was not as large as in the case of the head 1-1.

Figure 27:
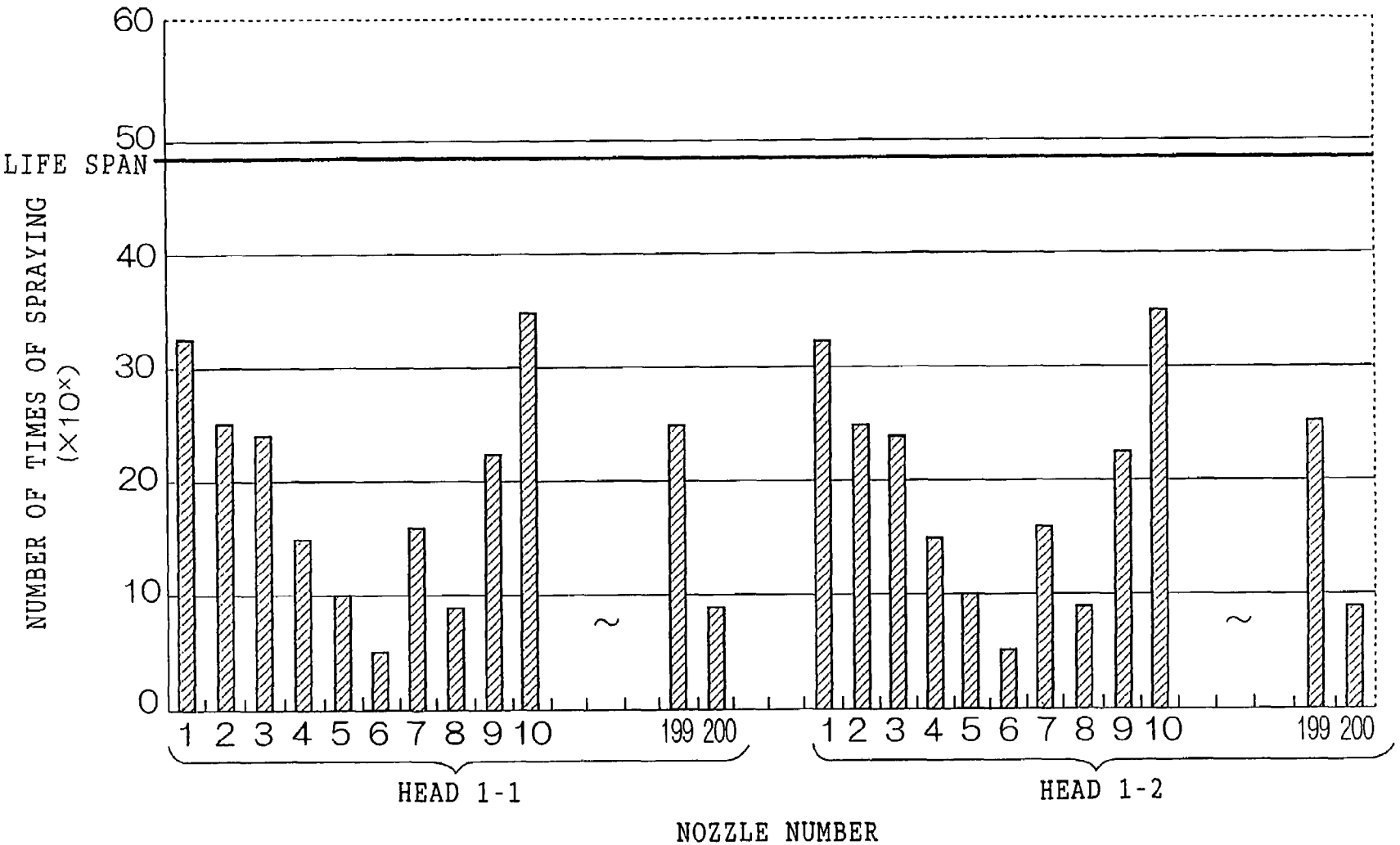
FIG. 27 is a spraying distribution diagram of the nozzles in the alternating control of the ink-jet line printer arrangement in FIG. 23.

FIG. 27 is a graph showing a distribution of the number of times that nozzles of the heads were used for spraying when at a certain period of time the positions of nozzles of the ink-jet head 1-1 and the ink-jet head 1-2 were alternated, under the same conditions as those illustrated in FIG. 26. In the example in FIG. 26, the number of times that nozzle No. 1 of the head 1-1 was used for spraying exceeds a set value of a life span. However, as shown in FIG. 27, when the positions of the heads 1-1 and 1-2 were alternated, the number of times that nozzle No. 1 was used for spraying was smaller than the set value of a life span.

The number of times that the heads 1-1 and 1-2 are used for spraying can thus be maintained at the same level, and an apparatus with a long life span can thus be achieved. In this example, two ink-jet heads have constituted the line printer. However, even when three or more ink-jet heads constitute the ink-jet line printer, the arrangements of the ink-jet heads can be alternated in the same way.

In this manner, when arrangements of multiple ink-jet heads are alternated on the basis of the number of times that nozzles have been used for spraying and on the basis of print data, a load on any given nozzle (head) is reduced, and an apparatus with a long life span can be achieved.

As for timings at which alternation of arrangements should be executed, appropriate timings might be the end of one printing instruction, a spray timing, or the timing of the turning on of a main switch. Decisions may be taken on the basis of a frequency of use on the part of a user, and on the basis of print data, and the like. Loads on individual heads can thus be minimized, and an apparatus with a long life span can be achieved.

[Positional Adjustment of Ink-Jet Heads]

In the ink-jet line printer according to the invention, in order to arrange multiple ink-jet heads in the width direction, the ink-jet heads must be aligned. As methods of alignment, an alignment in a rotating direction between the heads, and an alignment in horizontal and vertical directions between the heads, can be used. Since these alignments cannot be easily performed by visual adjustment because of high resolution, the alignments are automatically performed as follows.

Figure 28:
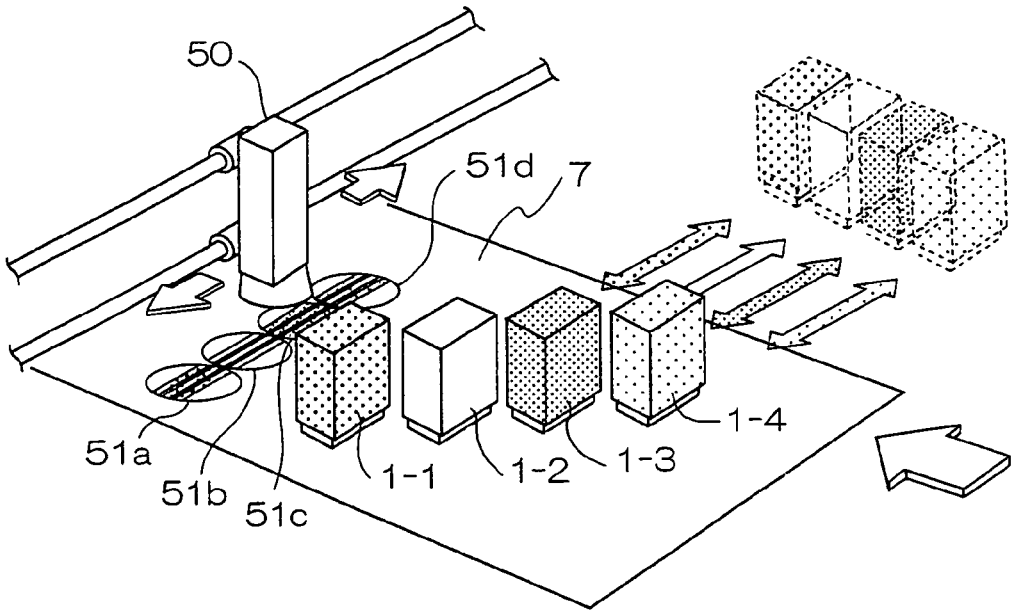
FIG. 28 is a diagram showing a configuration of head inclination correction of the ink-jet line printer according to the invention.
Figure 29:
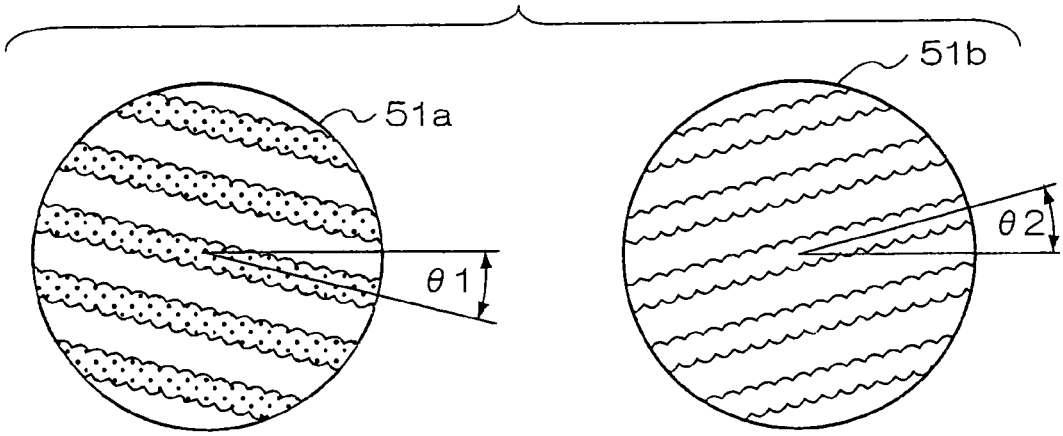
FIG. 29 is a diagram for explaining operation of head inclination correction of the ink-jet line printer according to the invention.

FIG. 28 is a diagram for explaining an embodiment of an alignment of the ink-jet heads according to the invention, and FIG. 29 is a diagram for explaining the alignment operation.

As shown in FIG. 28, four ink-jet heads 1-1 to 1-4 constitute a line printer. The printing ranges of the ink-jet heads 1-1 to 1-4 are respectively equal to the printing surfaces arranged. The ink-jet heads 1-1 to 1-4 do not move in a main scanning direction for printing. Although in this embodiment the ink-jet heads 1-1 to 1-4 are aligned in a zigzag pattern, the ink-jet heads 1-1 to 1-4 may be aligned according to other patterns.

The ink-jet heads 1-1 to 1-4 stop at arrangement positions and print a test pattern as shown in FIG. 29. Results of printing 51*a* to 51*d* are printed on the paper 7.

A CCD camera 50 is installed on the downstream side of the ink-jet heads 1-1 to 1-4 in a sub-scanning direction of the paper 7. In this embodiment, the CCD camera 50 can be moved in the main scanning direction of the paper 7. Alternatively, multiple CCD cameras 50 may also be arranged, so that the CCD cameras 50 may be installed between each head.

The CCD camera 50 first reads the results 51*a* to 51*d* printed by the ink-jet heads 1-1 to 1-4. The ink-jet controller 32 checks the inclination accuracies of each head on the basis of the output read, feeds back the inclination accuracies to the stages 3-1 to 3-4 of the heads 1-1 to 1-4, and thus corrects the inclinations of the heads.

FIG. 29 is an image captured by the CCD camera 50, and shows inclinations of printing caused by the inclinations of the fixed ink-jet heads 1-1 and 1-2. The inclinations θ1 and θ2 of the heads 1-1 and 1-2 are analyzed on the basis of the images 51*a* and 51*b* and inclination correction values of the heads 1-1 and 1-2 are calculated. The θ actuators 300 (see FIG. 5) of the stages 3-1 and 3-2 are driven to correct inclinations generated when the heads 1-1 and 1-2 were fixed. As for the heads 1-3 and 1-4, the same operation as that described above can be performed.

After the correction, a test pattern is again printed to reconfirm results of adjustment in a rotating direction. Upon completion of the adjustment in the rotating direction, as will be described later in accordance with FIG. 30, printing is again performed, and adjustments are made to displacements of the heads in both the main scanning direction and the sub-scanning direction.

Figure 30:
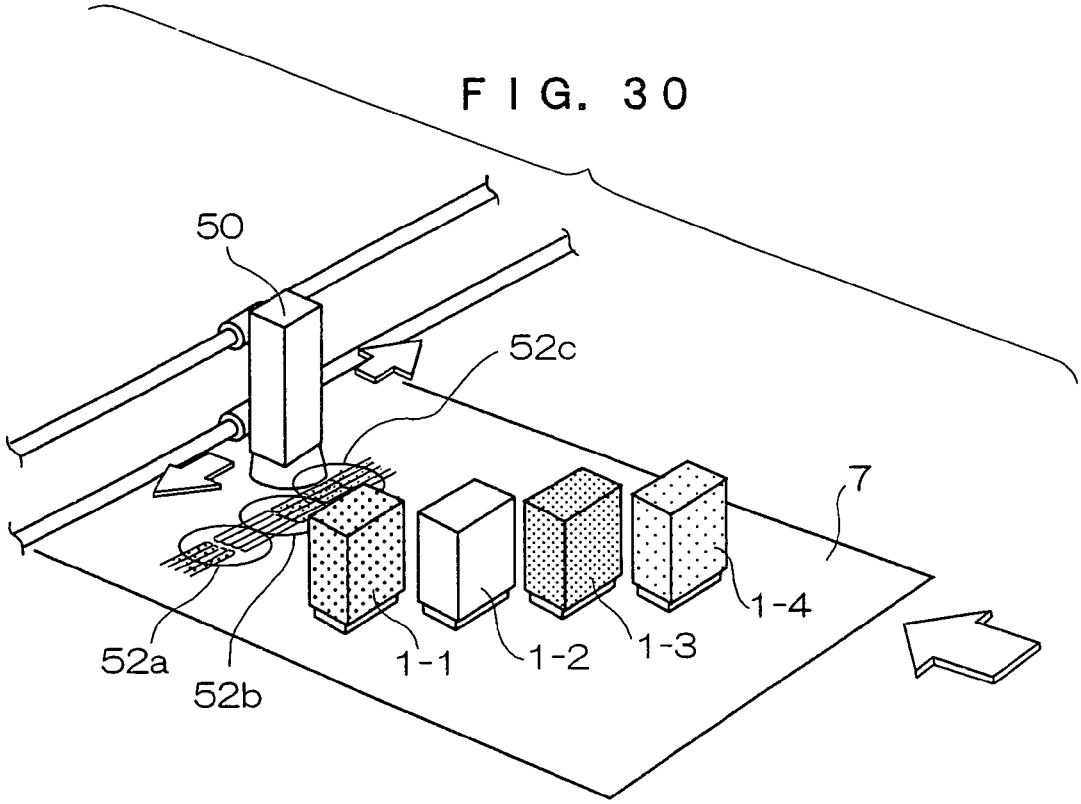
FIG. 30 is a diagram showing a configuration of displacement correction between the heads of the ink-jet line printer according to the invention.
Figure 31:
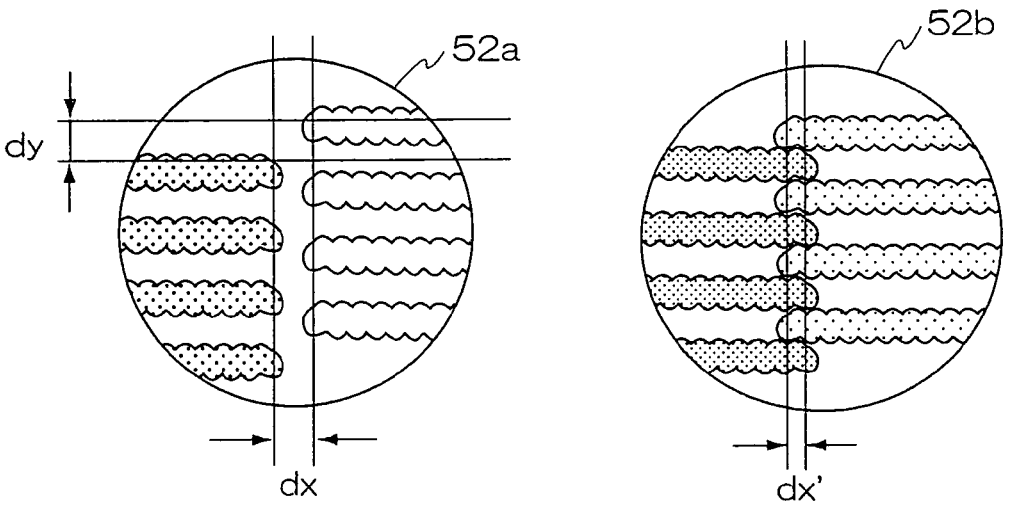
FIG. 31 is a diagram for explaining operation of displacement correction between the heads of the ink-jet line printer according to the invention.

As shown in FIG. 30, the same test patterns 52*a* to 52*d* are printed by each of the ink-jet heads 1-1 to 1-4 which have been corrected in rotating directions. The CCD camera 50 moves to an image-capturing position and reads images of joint portions in the printing ranges of each head. FIG. 31 is an image captured by the CCD camera 50, and shows printing errors caused by displacements of intervals between the ink-jet heads 1-1 to 1-4.

On the basis of the images 52*a* and 52*b* respectively, the ink-jet controller 32 analyzes a displacement dx in the main scanning direction and a displacement dy in the sub-scanning direction, and calculates displacement correction values. The ink-jet controller 32 drives the Y actuators 302 and the X actuators 304 (see FIG. 5) of the stages 3-1 to 3-4 of the ink-jet heads 1-1 to 1-4, and adjusts the displacements of the heads in both the main scanning direction and the sub-scanning direction.

For example, in terms of positional adjustment, by using the ink-jet head 1-1 as a yardstick, and taking into due consideration the magnitude of movement by which the head 1-2 has been corrected, a correction value of the head 1-3 is calculated, and taking into due consideration the correction values of the heads 1-2 and 1-3, a correction value of the head 1-4 is calculated.

Figure 32:
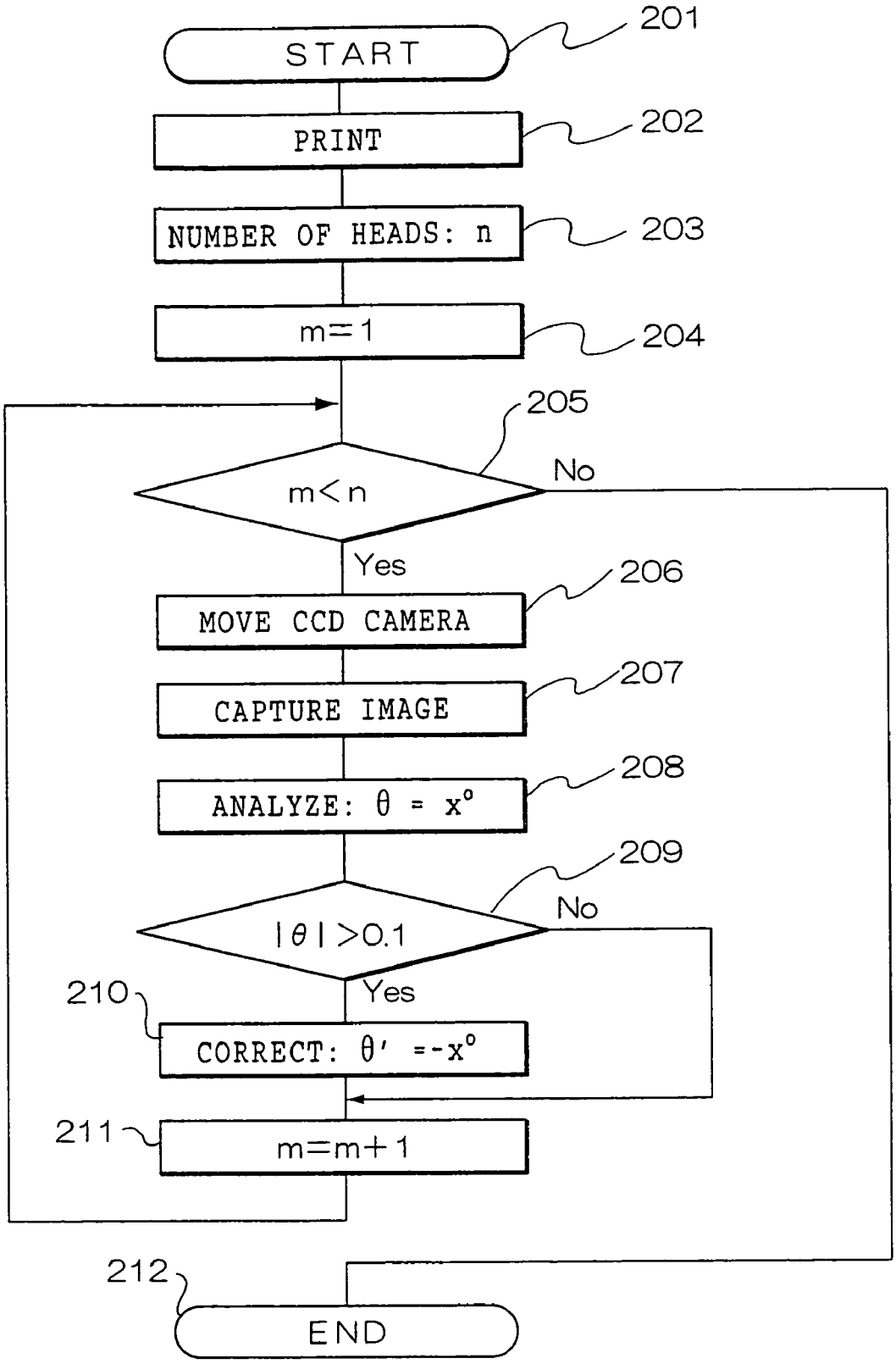
FIG. 32 is a flow chart of a head inclination correction process of the ink-jet line printer in FIG. 28.

FIG. 32 is a flow chart of a correction process of a rotational error of the ink-jet head, as illustrated in FIGS. 28 and 29.1*t* should be noted that FIG. 32 shows an embodiment in which one CCD camera 50 is arranged for capturing an image.

(S201) An adjustment process is started on the basis of an instruction to adjust in a rotating direction.

(S202) The ink-jet heads 1-1 to 1-4 print a test pattern.

(S203) As a pointer to the number of headers, the number of headers "n" (4 in FIG. 28) is set.

(S204) A reference head pointer m is initialized as "1".

(S205) It is determined whether or not the reference head pointer m is smaller than the number of heads n. When the reference head pointer m is not smaller than the number of heads n, the control flow shifts to step S212 to end the process.

(S206) When the reference head pointer m is smaller than the number of heads n, the CCD camera 50 is moved to a position set in advance by the pointer m.

(S207) The CCD camera 50 captures an image.

(S208) An inclination θ=X° of an ink-jet head is calculated on the basis of an analysis of image data captured.

(S209) An absolute value |θ| of the inclination and a tolerable inclination (for example, 0.1°) are compared. When the absolute value does not satisfy |θ|>0.1°, the control flow shifts to step S211.

(S210) When the absolute value does satisfy |θ|>0.1°, the θ actuator 300 of the stage is driven at a correction value θ'=−X° to perform rotational correction.

(S211) The reference head pointer m is incremented by "1", the control flow returns to step S205, and the next ink-jet head is corrected.

Figure 33:
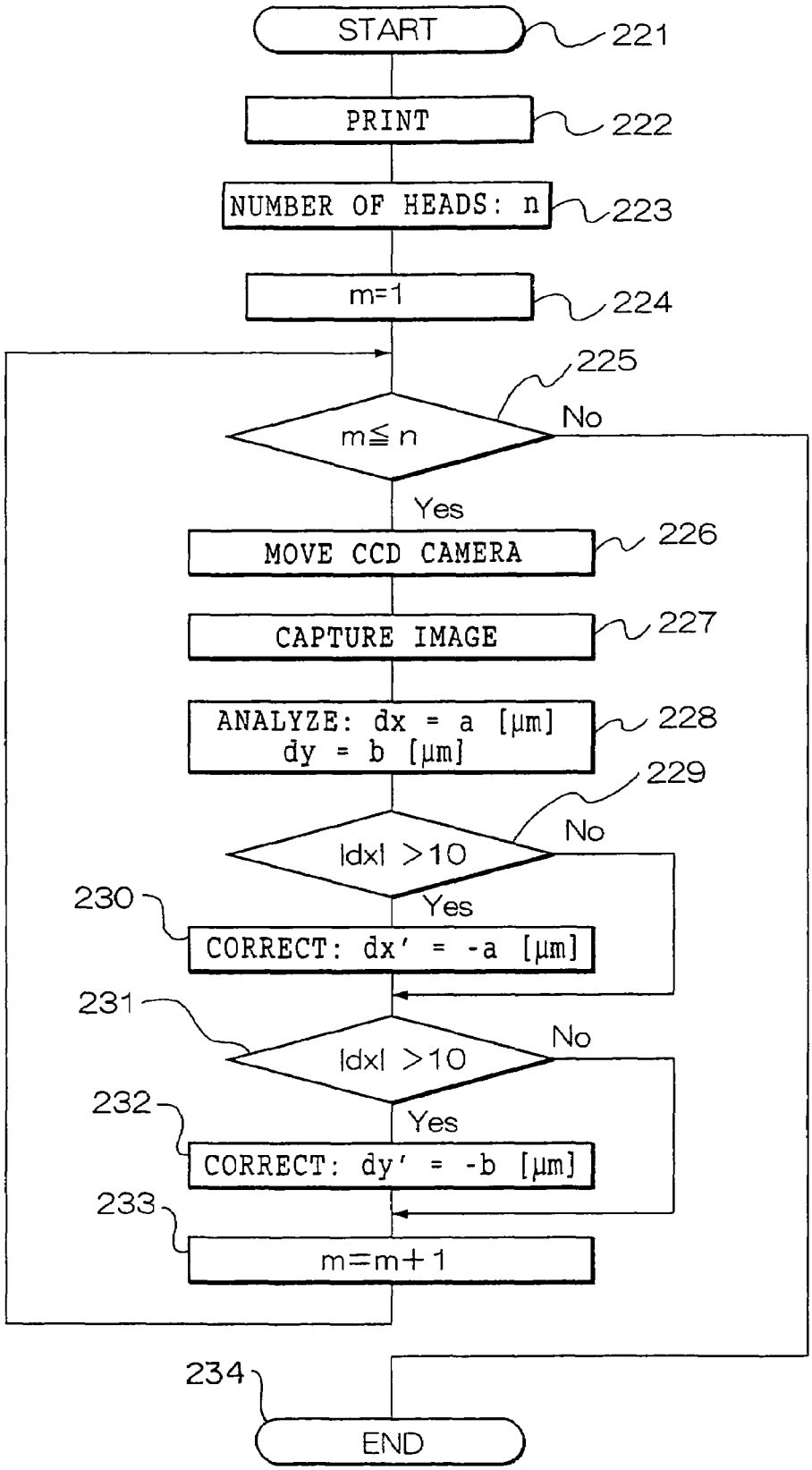
FIG. 33 is a flow chart of a process of displacement correction between the heads of the ink-jet line printer in FIG. 30.
Figure 34:
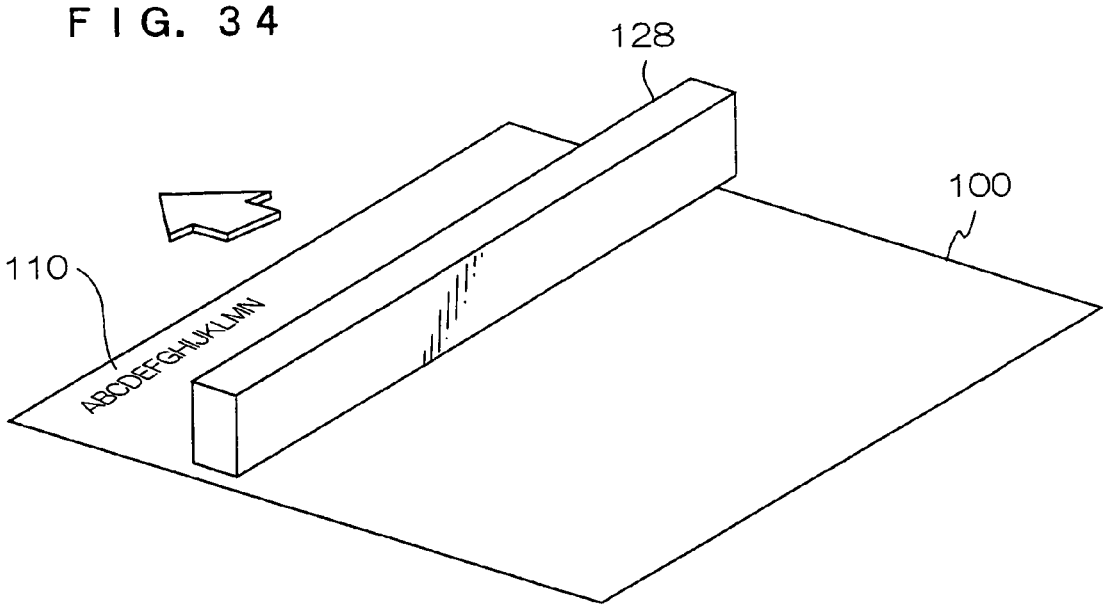
FIG. 34 is a diagram for explaining a first conventional ink-jet line printer.
Figure 35:
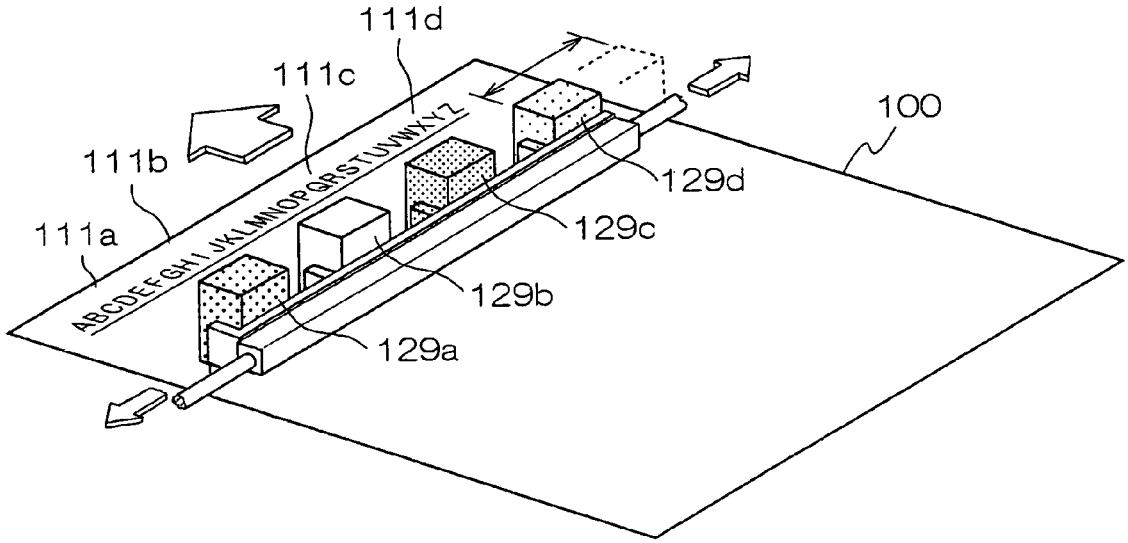
FIG. 35 is a diagram for explaining a second conventional ink-jet line printer.

FIG. 33 is a flow chart of a correction process of the positions of the heads in both the main scanning direction and a sub-scanning direction after the inclinations of the ink-jet heads have been corrected. As in the above description, FIG. 33 shows a case in which an operation is performed by a single CCD camera.

(S221) An adjustment process is started on the basis of instructions to adjust in both main and sub-canning directions.

(S222) The ink-jet heads 1-1 to 1-4 print a test pattern.

(S223) As a pointer to the number of heads, the number of heads "n" (4 in FIG. 30) is set.

(S224) The reference head pointer m is initialized as "1".

(S225) It is determined whether or not the reference head pointer m is smaller than the number of heads n. When the reference head pointer m is not smaller than the number of heads n, the control flow shifts to step S234 to end the process.

(S226) When the reference head pointer m is smaller than the number of heads n, the CCD camera 50 is moved to a position set in advance by the pointer m.

(S227) The CCD camera 50 captures an image.

(S228) Displacements dx and dy of the ink-jet heads in the main and sub-scanning directions are calculated on the basis of an analysis of the image data captured.

(S229) An absolute value |dx| of the displacement in the main scanning direction and a tolerable displacement (for example, 10 [μm]) are compared. When the absolute value |dx| does not exceed the tolerable displacement, the control flow shifts to step S231.

(S230) When the absolute value |dx| does exceed the tolerable level of displacement, the X actuator 304 of the stage of the head is driven at a correction value dx'=−a to correct the positions in the main scanning direction.

(S231) An absolute value |dy| of the displacement in the sub-scanning direction and a tolerable displacement (for example, 10 [μm]) are compared. When the absolute value |dy| does not exceed the tolerable level of displacement, the control flow shifts to step S233.

(S232) When the absolute value is |dx|>10, the Y actuator 302 of the stage is driven at a correction value dy'=−b to perform rotational correction.

(S233) The reference head pointer m is incremented by "1". The control flow returns to step S225 to correct the next ink-jet head.

When there is no need for the inclination directions of each head to be analyzed on the basis of assembly accuracy, a method can also be used of adjusting only displacements in the main scanning and sub-scanning directions. In addition, when the images 51*a*, 51*b*, 52*a*, and 52*b* to be captured are magnified, the inclinations θ and displacement dx and dy of the heads can be simultaneously detected, analyzed, and adjusted. In addition, when an output during printing is observed depending on the basis of the number of CCD cameras, printing deficiencies can be detected early, and measures to remedy defects in printing can be taken at an early stage.

As has been described above, in a line printer that performs printing by using multiple ink-jet heads, a system is incorporated which observes and analyzes results of printing and adjusts displacements of the heads on the basis of feedback. For this reason, the heads do not require a high degree of fixing accuracy, and a fixing operation of heads can be easily performed. As for print quality, missing characters and high-density parts caused by double printing can be avoided.

ANOTHER EMBODIMENT

Although the printing medium has been described above as continuous-form paper, the invention can also be applied to a cut medium. The printing medium is not limited to paper, and the printing medium may be made of other materials. Moreover, the image forming apparatus has been described as a page printer. However, the invention can also be applied to a copying machine, a facsimile, or the like.

The number of ink-jet heads constituting one line can be appropriately selected depending on the width of a printing medium, a resolution required, the cost of the heads, and the like. In short, two or more heads can be used.

In addition, the ink-jet heads may include not only nozzles for a single color but also nozzles for multiple colors.

The invention has been described with reference to the embodiments. However, various modifications can be effected without departing from the spirit and scope of the invention. These modifications are not excluded from the spirit and scope of the invention.

INDUSTRIAL POTENTIALITY

Multiple ink-jet heads constitute an ink-jet line printer, the ink-jet heads are designed to move between home positions and printing positions, and a backup mechanism is arranged at the home positions. For this reason, in the ink-jet line printer, the ink-jet heads can be protected and recovered by the backup mechanism, thus making it possible to perform high-speed continuous printing. Furthermore, even when a backup mechanism is incorporated, the apparatus can be kept compact.

What is claimed is:

1. An ink-jet line printer which, by spraying ink, performs in a single operation printing of an entire line of a printing medium crossing a conveyance direction of the printing medium, comprising:

a plurality of ink-jet heads arranged to cover a plurality of printing regions divided in a line direction of the printing medium and having a plurality of ink spraying nozzles arranged in the line direction;

a backup mechanism, arranged at a home position on a side of the printing medium, for protecting and recovering the nozzles of the plurality of ink-jet heads, wherein the backup mechanism has caps covering surfaces of the nozzles of the ink-jet heads, a purging mechanism which performs purging of the insides of the caps, covers covering the caps, and a drive mechanism that opens the covers when the ink-jet heads are located at positions of the caps;

an actuator which moves the ink-jet heads in the line direction between home positions and predetermined printing positions in the line direction, wherein the actuator is constituted by a plurality of guide rails, and each of the plurality of guide rails guide each of the ink-jet heads, respectively, towards the line direction; and a controller which, when a printing operation is to be performed in the line direction, positions the ink-jet heads at predetermined print positions in the line direction, performs printing by ink jet printing while remaining stationary, and, at a time when a printing operation is not about to take place, moves the ink-jet heads to home positions, thus enabling the backup mechanism to protect and recover the nozzles.

2. The ink-jet line printer according to claim 1, wherein the actuator is further constituted by a plurality of stages that move the ink-jet heads along the guide rails of the ink-jet heads.

3. The ink-jet line printer according to claim 2, wherein the stages have a first actuator that moves the ink-jet heads in the line direction, and a second actuator that moves the ink-jet heads in a direction perpendicular to the line direction.

4. The ink-jet line printer according to claim 1, wherein, on a conveyance path opposite to surfaces of the nozzles of ink-jet heads, a tension imparting unit is provided that imparts tension to the printing medium.

* * * * *